US008184816B2

(12) United States Patent
Ramakrishnan et al.

(10) Patent No.: US 8,184,816 B2
(45) Date of Patent: May 22, 2012

(54) SYSTEMS AND METHODS FOR DETECTING WIND NOISE USING MULTIPLE AUDIO SOURCES

(75) Inventors: Dinesh Ramakrishnan, San Diego, CA (US); Song Wang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 636 days.

(21) Appl. No.: 12/323,186

(22) Filed: Nov. 25, 2008

(65) Prior Publication Data

US 2009/0238369 A1 Sep. 24, 2009

Related U.S. Application Data

(60) Provisional application No. 61/037,453, filed on Mar. 18, 2008.

(51) Int. Cl.
*H04R 3/00* (2006.01)

(52) U.S. Cl. ..... 381/56; 381/92

(58) Field of Classification Search ..... 381/56
See application file for complete search history.

(56) References Cited

U.S. PATENT DOCUMENTS

| | | | | |
|---|---|---|---|---|
| 5,511,128 | A | 4/1996 | Lindemann | |
| 6,154,552 | A | 11/2000 | Koroljow et al. | |
| 6,594,367 | B1 | 7/2003 | Marash et al. | |
| 7,099,821 | B2 | 8/2006 | Visser et al. | |
| 7,130,429 | B1 * | 10/2006 | Dalgaard et al. | 381/67 |
| 7,366,662 | B2 | 4/2008 | Visser et al. | |
| 2002/0048376 | A1 * | 4/2002 | Ukita | 381/92 |
| 2003/0027600 | A1 | 2/2003 | Krasny et al. | |
| 2003/0147538 | A1 | 8/2003 | Elko | |
| 2004/0161120 | A1 | 8/2004 | Petersen et al. | |
| 2005/0047611 | A1 | 3/2005 | Mao | |
| 2005/0141731 | A1 | 6/2005 | Hamalainen | |
| 2005/0149320 | A1 | 7/2005 | Kajala et al. | |
| 2006/0120540 | A1 * | 6/2006 | Luo | 381/98 |
| 2006/0153360 | A1 | 7/2006 | Kellermann et al. | |

(Continued)

FOREIGN PATENT DOCUMENTS

WO WO2004008804 1/2004

(Continued)

OTHER PUBLICATIONS

Cohen I, et al., "Two-channel signal detection and speech enhancement based on the transient beam-to-reference ratio" Proceedings of International Conference on Acoustics, Speech and Signal Processing (ICASSP'03) Apr. 6-10, 2003 Hong Kong, China; [IEEE International Conference on Acoustics, Speech, and Signal Processing ( ICASSP ), 2003 IEEE International Conference, vol. 5, Apr. 6, 2003, pp. V_233-V_236, XP010639251.

(Continued)

*Primary Examiner* — Benjamin Sandvik
(74) *Attorney, Agent, or Firm* — Espartaco Diaz Hidalgo

(57) ABSTRACT

A method for detecting wind noise is described. At least two audio signals are received. The at least two audio signals are filtered to reduce higher frequencies and to reduce lower frequencies to provide at least two filtered audio signals. The cross correlation of the at least two filtered audio signals is computed for multiple delays. A maximum cross correlation is determined from the cross correlations computed for the multiple delays. Wind noise is detected by comparing the maximum cross correlation with a threshold.

45 Claims, 16 Drawing Sheets

U.S. PATENT DOCUMENTS

| | | | | |
|---|---|---|---|---|
| 2006/0222184 | A1 | 10/2006 | Buck et al. | |
| 2007/0088544 | A1 | 4/2007 | Acero et al. | |
| 2007/0274534 | A1 | 11/2007 | Lockhart et al. | |
| 2009/0089053 | A1 | 4/2009 | Wang et al. | |
| 2009/0190774 | A1 | 7/2009 | Wang et al. | |
| 2009/0238377 | A1 | 9/2009 | Ramakrishnan et al. | |
| 2009/0240495 | A1 * | 9/2009 | Ramakrishnan et al. | 704/226 |
| 2009/0304203 | A1 | 12/2009 | Haykin et al. | |

FOREIGN PATENT DOCUMENTS

| | | | |
|---|---|---|---|
| WO | WO2008037925 | A1 | 4/2008 |
| WO | WO2008101198 | A2 | 8/2008 |

OTHER PUBLICATIONS

Fa-Long Luo and Arye Nehorai,"Recent developments in signal processing for digital hearing aids," IEEE Signal Processing Magazine, pp. 103-106, Sep. 2006.

International Search Report—PCT/US2009/037485—International Search Authority—European Patent Offfice, Oct. 9, 2009.

Michael R. Shust, "Active removal of wind noise from outdoor microphones using local velocity measurements", PhD disseration, Michigan Technological University, Jul. 1998.

Written Opinion—PCT/US2009/037485, International Search Authority, European Patent Office, Sep. 10, 2009.

* cited by examiner

SYSTEMS AND METHODS FOR DETECTING WIND NOISE USING MULTIPLE AUDIO SOURCES

RELATED APPLICATIONS

This application is related to and claims priority from U.S. Provisional Patent Application Ser. No. 61/037,453, filed Mar. 18, 2008, for WIND GUSH DETECTION USING MULTIPLE MICROPHONES, with inventors Dinesh Ramakrishnan and Song Wang, which is incorporated herein by reference.

TECHNICAL FIELD

The present disclosure relates generally to audio processing. More specifically, the present disclosure relates to detecting wind noise using multiple audio signals recorded using electro-acoustic transducers such as microphones.

BACKGROUND

Communication technologies continue to advance in many areas. As these technologies advance, users have more flexibility in the ways they may communicate with one another. For telephone calls, users may engage in direct two-way calls or conference calls. In addition, headsets or speakerphones may be used to enable hands-free operation. Calls may take place using standard telephones, cellular telephones, computing devices, etc.

This increased flexibility enabled by advancing communication technologies also makes it possible for users to make calls from many different kinds of environments. In some environments, various conditions may arise that can affect the call. One condition is the wind or air movement.

Wind noise has historically been a significant detractor of audio quality, particularly when the audio has been captured by microphones in an outdoor setting. The audio quality in mobile devices (e.g. cell phones, laptops, etc.) has been particularly vulnerable to this problem. Detection of wind noise is an ongoing effort in the wireless communication industry. Hence, benefits may be realized by providing improved systems and methods for detecting wind noise.

DETAILED DESCRIPTION

Figure 1:
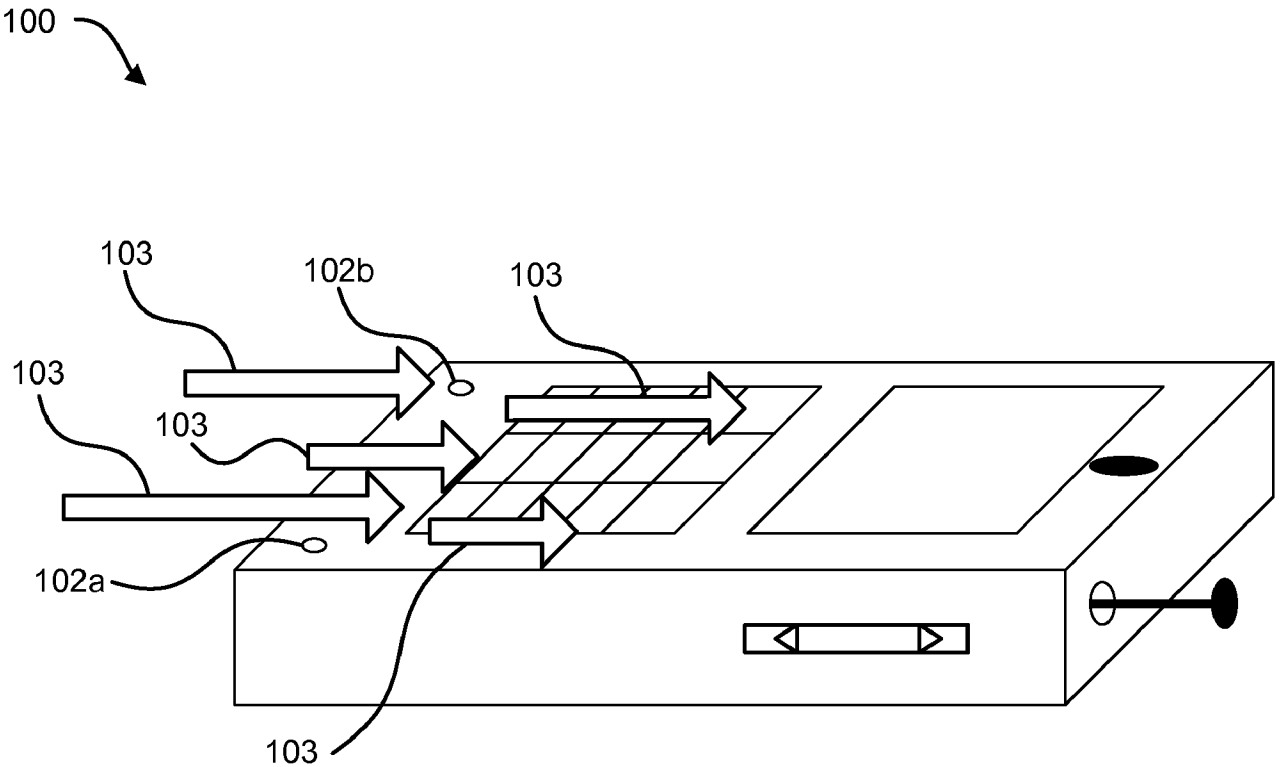
FIG. 1 is an illustration of a wireless communications device and an example showing how airflow may cause noise in audio signals in the wireless communication device.

A method for detecting wind noise is disclosed. At least two audio signals are received. The at least two audio signals are filtered to reduce higher frequencies and to reduce lower frequencies to provide at least two filtered audio signals. The cross correlation of the at least two filtered audio signals is computed for multiple delays. A maximum cross correlation is determined from the cross correlations computed for the multiple delays. Wind noise is detected by comparing the maximum cross correlation with a threshold.

The filtering to reduce the higher frequencies may be accomplished by a low pass filter. The filtering to reduce the lower frequencies may be accomplished by a high pass filter. In another configuration, the filtering to reduce the higher frequencies and to reduce the lower frequencies may be accomplished by a band pass filter.

Computing the cross correlation may include computing the normalized cross correlation. Computing the cross correlation may include computing the smoothed normalized cross correlation.

The at least two audio signals may be converted from analog audio to digital audio. In one configuration, the at least two audio signals may comprise exactly two audio signals. The digital audio may be divided into multiple blocks. The computing, the determining and the detecting may be performed relative to the blocks.

A percentage of wind noise detections over a window may be monitored and compared with a threshold percentage to determine wind noise for the window. The method may also include determining which audio signal of the at least two audio signals has wind noise.

A wireless communication device configured to detect wind noise is disclosed. The communication device includes at least two microphones for receiving at least two audio signals. The communication device also includes filters for filtering the at least two audio signals to reduce higher frequencies and to reduce lower frequencies to provide at least two filtered audio signals. A cross correlation block is coupled to the filters for computing the cross correlation of the at least two filtered audio signals for multiple delays. A maximum determination block is coupled to the cross correlation block for determining a maximum cross correlation from the cross correlations computed for the multiple delays. A decision block is coupled to the maximum determination block for detecting wind noise by comparing the maximum cross correlation with a threshold.

A wireless communication device configured for detecting wind noise is disclosed. The communication device includes a processor and memory in electronic communication with the processor. Executable instructions are stored in the memory. At least two audio signals are received. The at least two audio signals are filtered to reduce higher frequencies and to reduce lower frequencies to provide at least two filtered audio signals. The cross correlation of the at least two filtered audio signals is computed for multiple delays. A maximum cross correlation is determined from the cross correlations computed for the multiple delays. Wind noise is detected by comparing the maximum cross correlation with a threshold.

A wireless communication device configured for detecting wind noise is disclosed. The communication device includes means for receiving at least two audio signals and means for filtering the at least two audio signals to reduce higher frequencies and to reduce lower frequencies to provide at least two filtered audio signals. The communication device also includes means for computing the cross correlation of the at least two filtered audio signals for multiple delays. The communication device includes means for determining a maximum cross correlation from the cross correlations computed for the multiple delays. The communication device also includes means for detecting wind noise by comparing the maximum cross correlation with a threshold.

A computer-program product for detecting wind noise. The computer-program product comprises a computer-readable medium having instructions thereon. The instructions include code for receiving at least two audio signals and code for filtering the at least two audio signals to reduce higher frequencies and to reduce lower frequencies to provide at least two filtered audio signals. The instructions include code for computing the cross correlation of the at least two filtered audio signals for multiple delays. The instructions also include code for determining a maximum cross correlation from the cross correlations computed for the multiple delays. The instructions further include code for detecting wind noise by comparing the maximum cross correlation with a threshold.

An integrated circuit for detecting wind noise is disclosed. At least two audio signals are received. The at least two audio signals are filtered to reduce higher frequencies and to reduce lower frequencies to provide at least two filtered audio signals. The cross correlation of the at least two filtered audio signals is computed for multiple delays. A maximum cross correlation is determined from the cross correlations computed for the multiple delays. Wind noise is detected by comparing the maximum cross correlation with a threshold.

Mobile communication devices are inherently susceptible to environmental noises due to the mobile aspect of the communication device. One particular type of environmental noise that poses a problem in mobile communications is wind noise. Wind noise can degrade voice communication to such an extent that it is either unpleasant or intolerable. Therefore, detection and removal of wind noise plays an important role in improving the overall quality of voice communications. The present systems and methods detect wind gush or wind noise in mobile devices that employ multiple microphones. Detection of the presence of wind noise can be further used in different ways for improving the voice quality of the mobile communication systems.

Wind noise may be caused by airflow interacting with an electro-acoustic transducer (e.g., a microphone). Turbulence in the passing air flow may set up a violent flapping motion in a microphone diaphragm and may cause significant degradation to the acoustic signals picked up by the microphone. A high volume of air flow may also cause saturation in the microphone signals. Wind noise may have a broad frequency spectrum with significant energy in the low frequencies (e.g. less than 1 KHz). Wind noise energy in the high frequencies may roll off as frequency increases.

Wind noise poses a major challenge in voice communication systems. The broadband and highly non-stationary nature of wind noise makes it hard to detect and remove. Furthermore, saturation caused by wind noise introduces permanent non-linear damage in the acoustic signal which cannot be recovered.

Detection and removal of wind noise is an ongoing effort in the wireless communication industry as it can offer significant improvement in the quality of voice communications in outdoor scenarios. Detection and removal of wind noise are two different problems. The present systems and methods may be used for detecting wind noise. A mobile handset may be equipped with two or more microphones so that signals captured by multiple microphones may be exploited for detecting wind noise. Once the presence of wind noise is detected, it may be further utilized for improving the quality of the transmitted audio in various ways (e.g., to select the microphone signal with the least wind noise, to control signal processing modules such as adaptive filters, frequency domain techniques, noise suppressors, echo cancellers, etc.).

FIG. 1 is an illustration of a wireless communications device 100 and an example showing how airflow (e.g. wind) may cause noise in audio signals in the wireless communication device 100. The wireless communications device 100 includes two microphones 102*a*, 102*b*. For ease of illustration, the example presented shows a mobile handset 100 with only two microphones. However, it is straightforward to extend the proposed approach to more microphones.

There are two major sources of wind noise in unscreened microphone signals. The first component of wind noise may be caused by interaction between microphones 102*a-b* and adjacent airflow 103. This component is typically the dominant source of wind noise in a wireless communication device 100 (e.g. mobile handset, mobile station, wired handset, Bluetooth headset, etc.). This component has a broad frequency spectrum with most of its energy at low frequency. As the wind speeds increase, the bandwidth of this wind noise component may increase. This wind noise component may not have significant energy at high frequencies (e.g. greater than 1 KHz). An important property of this wind noise component is that the noise captured by different microphones 102*a-b* tends to be uncorrelated with each other.

The second component of wind noise may be caused by the pressure fluctuation of passing wind. This component may have a lot of low frequency content (e.g. under 200 Hz). When captured by different microphones 102*a-b*, this component tends to be correlated provided that the microphones 102*a-b* are not too far apart from each other (e.g. not more than 10 cm).

Wind noise detection systems and methods are described that exploit the characteristics of the dominant (first) wind noise component. The dominant wind noise component may have most of its energy in the band 200 Hz to 1000 Hz. In this frequency band, the acoustic (e.g. audio, voice, etc.) signals captured by microphones 102*a-b* tend to be correlated, whereas the first wind noise component captured by the microphones 102*a-b* tends to be uncorrelated. This property forms the basis for methods and systems for detecting wind noise in multiple audio signals.

Figure 2:
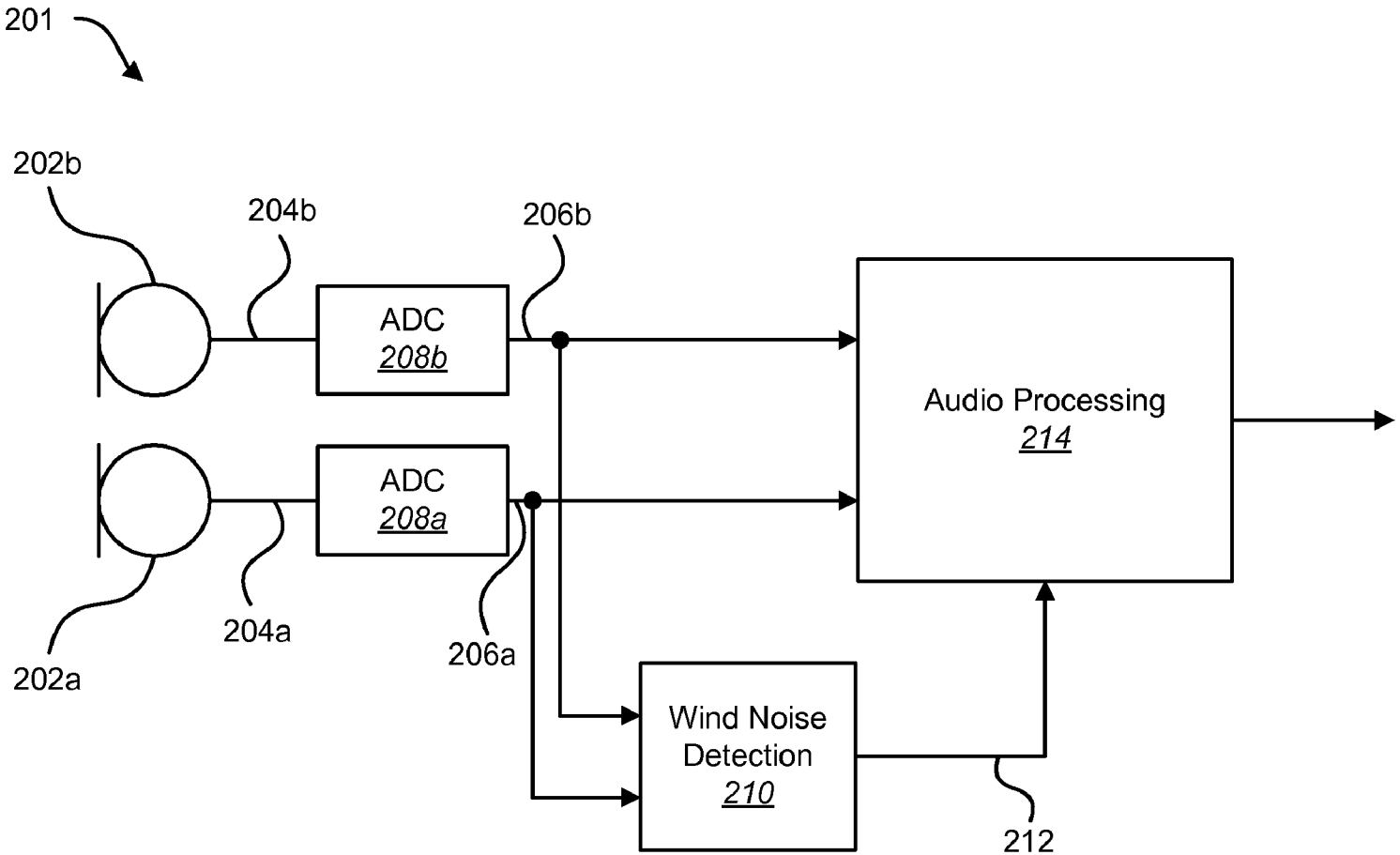
FIG. 2 is a block diagram illustrating some aspects of one possible configuration of a system including wind noise detection.

FIG. 2 is a block diagram illustrating some aspects of one possible configuration of a system 201 including wind noise detection 210. Transducers 202*a*, 202*b* capture sound information and convert it to an analog signal 204*a*, 204*b*. Transducers 202*a*, 202*b* may include any device or devices used for converting sound information into electrical (or other) signals. For example, they may be electro-acoustic transducers such as microphones. Analog-to-Digital Converters (ADCs) 208*a*, 208*b*, may convert the analog signals 204*a*, 204*b*, captured by the transducers 202*a*, 202*b* into digital signals 206*a*, 206*b*. ADCs 208*a*, 208*b* may sample analog signals at a sampling frequency $f_s$. The audio processing block 214 may receive and process digital audio signals 206*a*, 206*b*. The processing by the audio processing block 214 may be independent of the wind noise detection block 210.

The wind noise detection block 210 may receive and process the digital audio signals 206*a*, 206*b* to detect wind noise. Upon detecting wind noise, the wind noise detection block 210 may provide a signal 212 to the audio processing block 214. The signal 212 may indicate whether or not there is wind noise and may be used as a control signal or any other signal intended to utilize wind noise detection 210.

Figure 3:
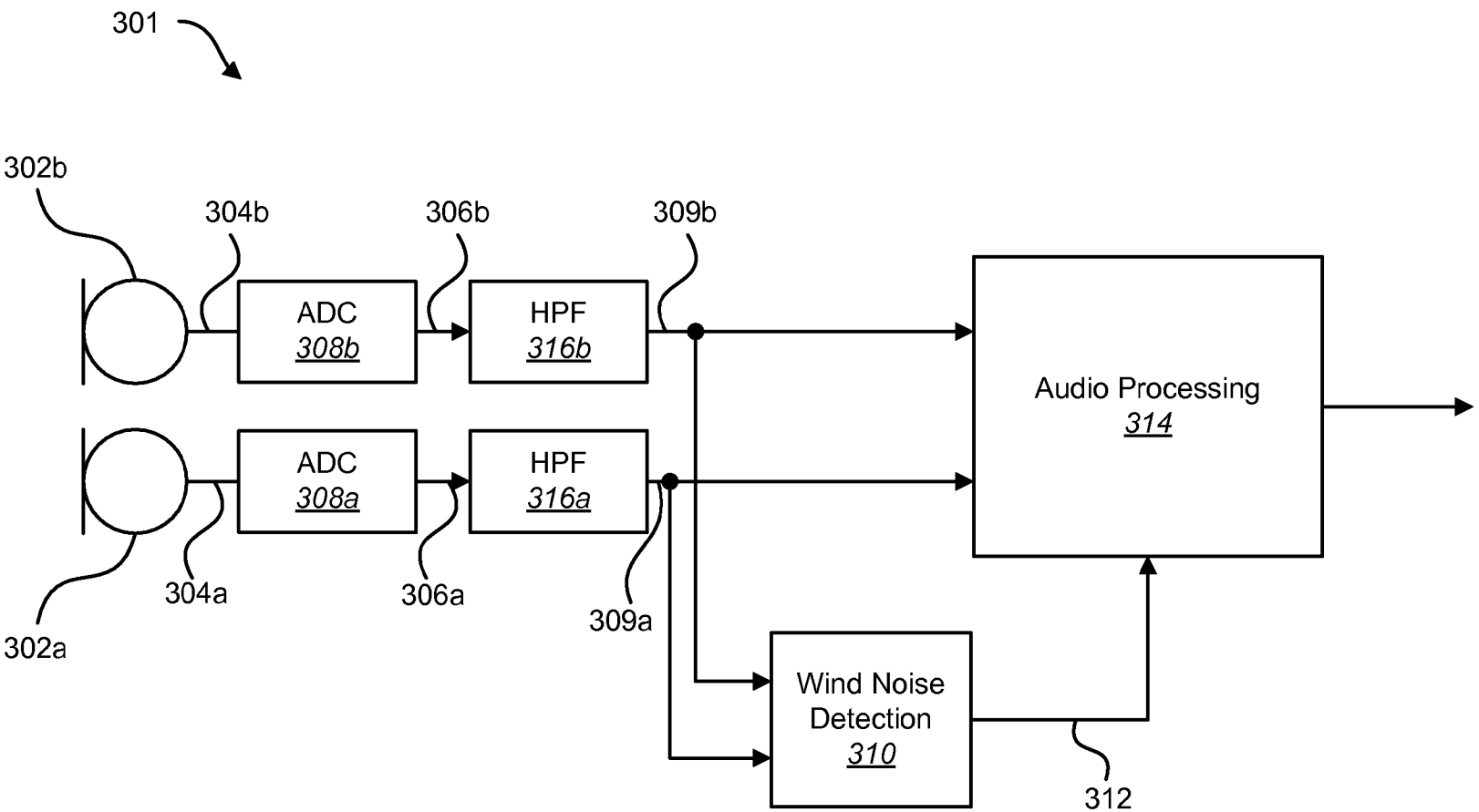
FIG. 3 is a block diagram illustrating some aspects of another possible configuration of a system including wind noise detection.

FIG. 3 is a block diagram illustrating some aspects of another possible configuration of a system 301 including wind noise detection 310. Microphones 302*a*, 302*b* capture sound information, and ADCs 308*a*, 308*b* convert analog audio signals 304*a*, 304*b* to digital audio signals 306*a*, 306*b*. The High Pass Filters (HPFs) 316*a*, 316*b* may be digital signal filters. The HPFs 316*a*, 316*b* may be first, second, or higher order IIR (Infinite Impulse Response) filters. The HPFs 316*a*, 316*b* may also be FIR (Finite Impulse Response) filters. The type of HPFs 316*a*, 316*b* may be fixed or varied (e.g. Butterworth, Chebyshev, etc.). The HPFs 316*a*, 316*b* may be designed to filter out portions of an audio signal below a certain cutoff frequency. The cutoff frequencies for the HPFs' 316*a*, 316*b* may be the same or different from each other's. In one configuration, the HPFs 316*a*, 316*b* may have a cutoff frequency of 200 Hz. Depending on the implementation, the cutoff frequencies may be fixed or they may be adjustable and/or adaptive based on the needs of the overall system 301. The HPFs 316*a*, 316*b* in the front end may help to remove the second wind noise component that is caused by pressure fluctuation of passing air. The audio processing block 314 and the wind noise detection block 310 may receive and process digital audio signals 309*a*, 309*b*. The wind noise detection block 310 may detect wind noise. Upon detecting wind noise, the wind noise detection block 310 may provide a signal 312 to the audio processing block 314 to indicate whether wind noise was detected.

Figure 4A:
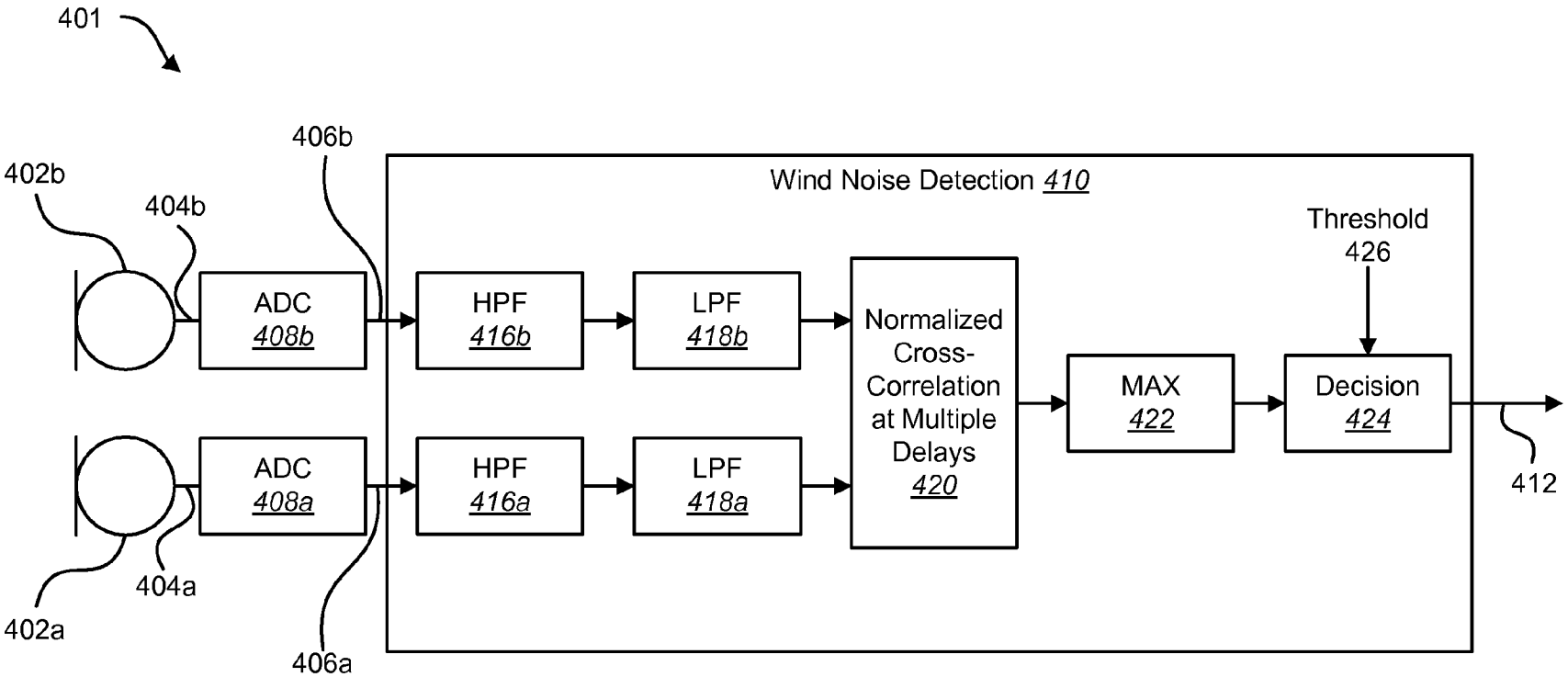
FIG. 4*a* is a block diagram illustrating certain aspects of one possible configuration of a wind noise detection system.

FIG. 4*a* is a block diagram illustrating certain aspects of one possible configuration of a system 401 with a wind noise detector 410. As shown, the wind noise detector 410 of FIG. 4 includes HPFs 416*a*, 416*b*, and thus may correspond to the broader block diagram of FIG. 2 where the wind noise detection 210 is coupled to the ADCs 208*a*, 208*b*. However, as shown in FIG. 3, one possible configuration of the wind noise detector 310 may not include the HPFs 316*a*, 316*b*.

Microphones 402*a*, 402*b* capture sound information, ADCs 408*a*, 408*b* convert analog audio signals 404*a*, 404*b* to digital audio signals 406*a*, 406*b*, and HPFs 416*a*, 416*b* filter the digital audio signals 406*a*, 406*b*. The HPFs 416*a*, 416*b* may be followed by Low Pass Filters (LPFs) 418*a*, 418*b*. The LPFs 418*a*, 418*b* may be digital signal filters. The LPFs 418*a*, 418*b* may be first, second, or higher order IIR filters or FIR filters. The type of LPFs 418*a*, 418*b* may be fixed or varied (e.g. Butterworth, Chebyshev, etc.). The LPFs 418*a*, 418*b* may be designed to filter out a portion of a digital signal above a cutoff frequency. The LPFs' 418*a*, 418*b* cutoff frequencies may be the same as or different from each other's. In one possible configuration, the LPFs' 418*a*, 418*b* cutoff frequencies may be set between 800 Hz and 1 kHz. The LPFs' 418*a*, 418*b* cutoff frequencies may be fixed, adjustable and/or adaptive. The LPFs 418*a*, 418*b* may have a roll-off of 40 dB/decade. The LPFs 418*a*, 418*b* may be used for emphasizing the frequency band containing the dominant wind noise content.

The LPFs 418*a*, 418*b* may be followed by a normalized cross-correlation block 420 that may estimate the normalized cross-correlation between the filtered microphone signals. The spacing between microphones 402*a*, 402*b* on a wireless communication device (e.g. 100) may be as large as 10 cm, and the signals captured by the two microphones 404*a*, 404*b* may be delayed with respect to each other. Hence the normalized cross-correlation estimate may be computed at multiple delay values between the two audio signals 404*a*, 404*b*. The normalized cross-correlation block may also be computed without additional delay values (e.g. 0 delay assumed). The MAX block 422 may find the maximum absolute normalized cross-correlation among all delays.

At the decision block 424, the maximum normalized cross-correlation may be compared against a threshold 426 to make a decision on wind noise detection. Wind noise may be detected when the maximum normalized cross-correlation is less than the threshold 426. The threshold 426 may be fixed, adaptive, or it 426 may be determined empirically or theoretically. In one implementation, the threshold 426 may be between 0.35 and 0.4. A signal 412 may be provided that indicates whether wind noise was detected and/or that includes wind noise detection information (i.e., it may include more information than simply a Boolean value).

Figure 4B:
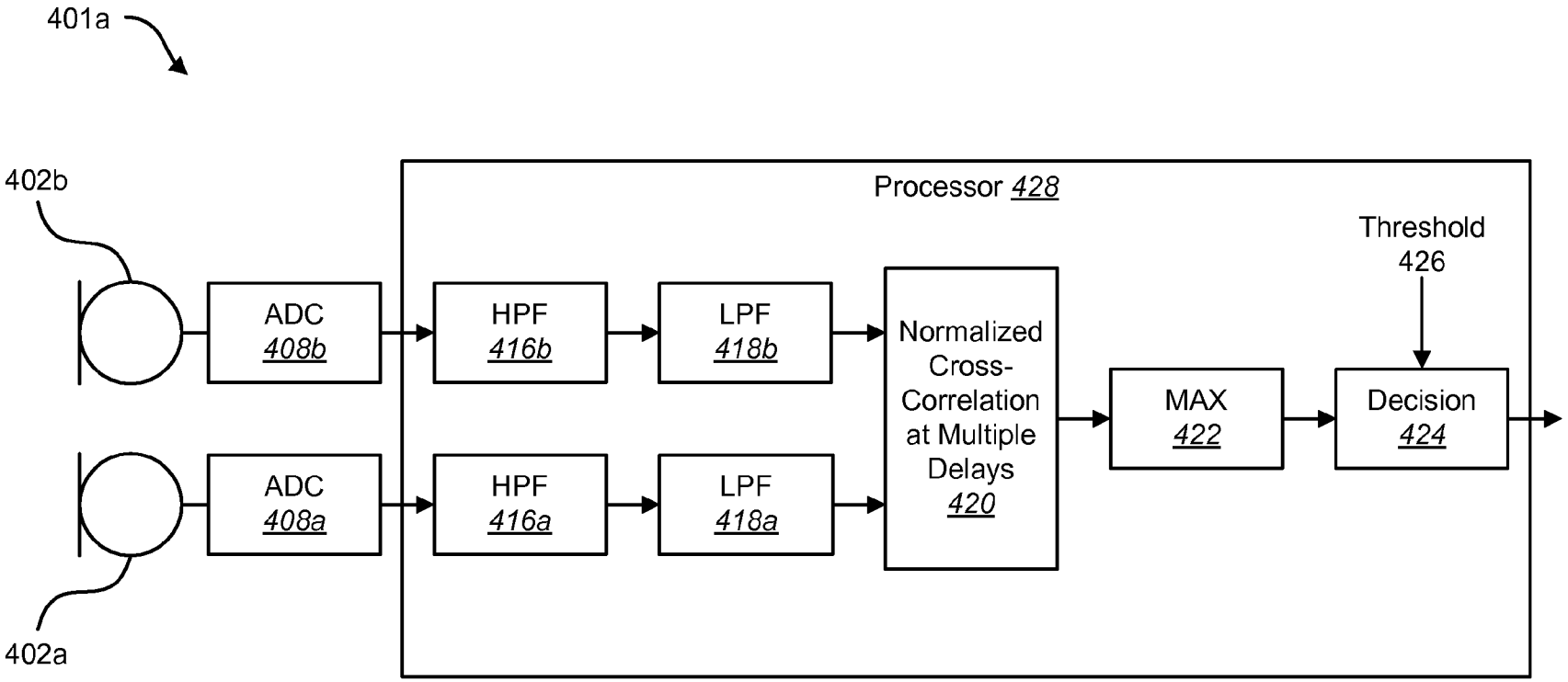
FIG. 4*b* is a block diagram illustrating certain aspects of one possible implementation of a wind noise detection system.

FIG. 4*b* is a block diagram illustrating certain aspects of one possible implementation of a wind noise detection system 401*a*. A processor 428 may execute instructions in order to implement the HPFs 416*a*, 416*b*, LPFs 418*a*, 418*b*, normalized cross-correlation block 420, MAX block 422, and/or decision block 424. The necessary instructions may be loaded from memory (shown below) and executed by the processor to implement the system and described. Alternative hardware and software components may also be used, as will be explained herein.

Figure 4C:
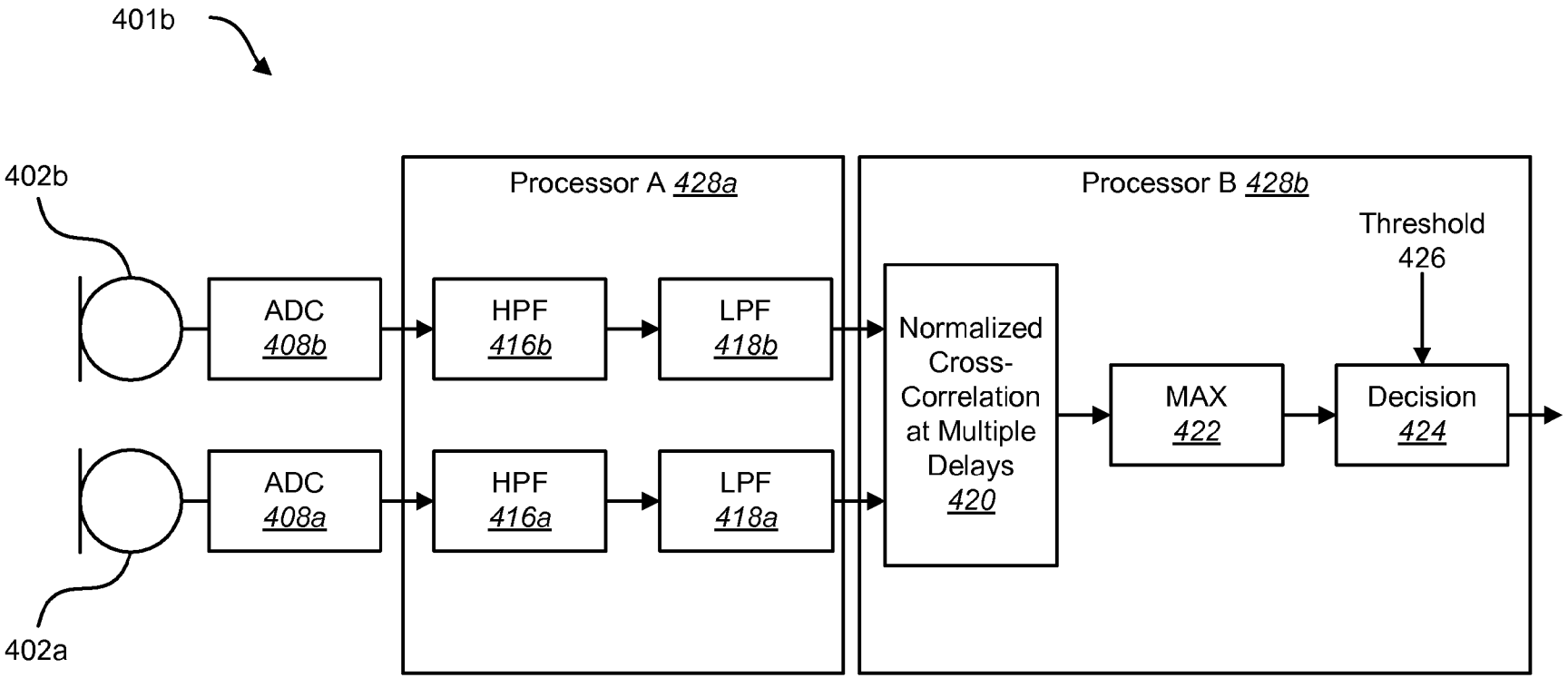
FIG. 4*c* is a block diagram illustrating certain aspects of another possible implementation of a wind noise detection system.

FIG. 4*c* is a block diagram illustrating certain aspects of another possible implementation of a wind noise detection system 401*b*. In the implementation shown in FIG. 4*c*, two processors are used for implementing the system 401*b*. Processor A 428*a* may execute instructions in order to implement the HPFs 416*a*, 416*b* and/or the LPFs 418*a*, 418*b*. Another processor, processor B 428*b* may be used to implement the normalized cross-correlation block 420, MAX block 422, and/or decision block 424. Individual processors may be arranged to handle each block individually or any combination of blocks.

Figure 5A:
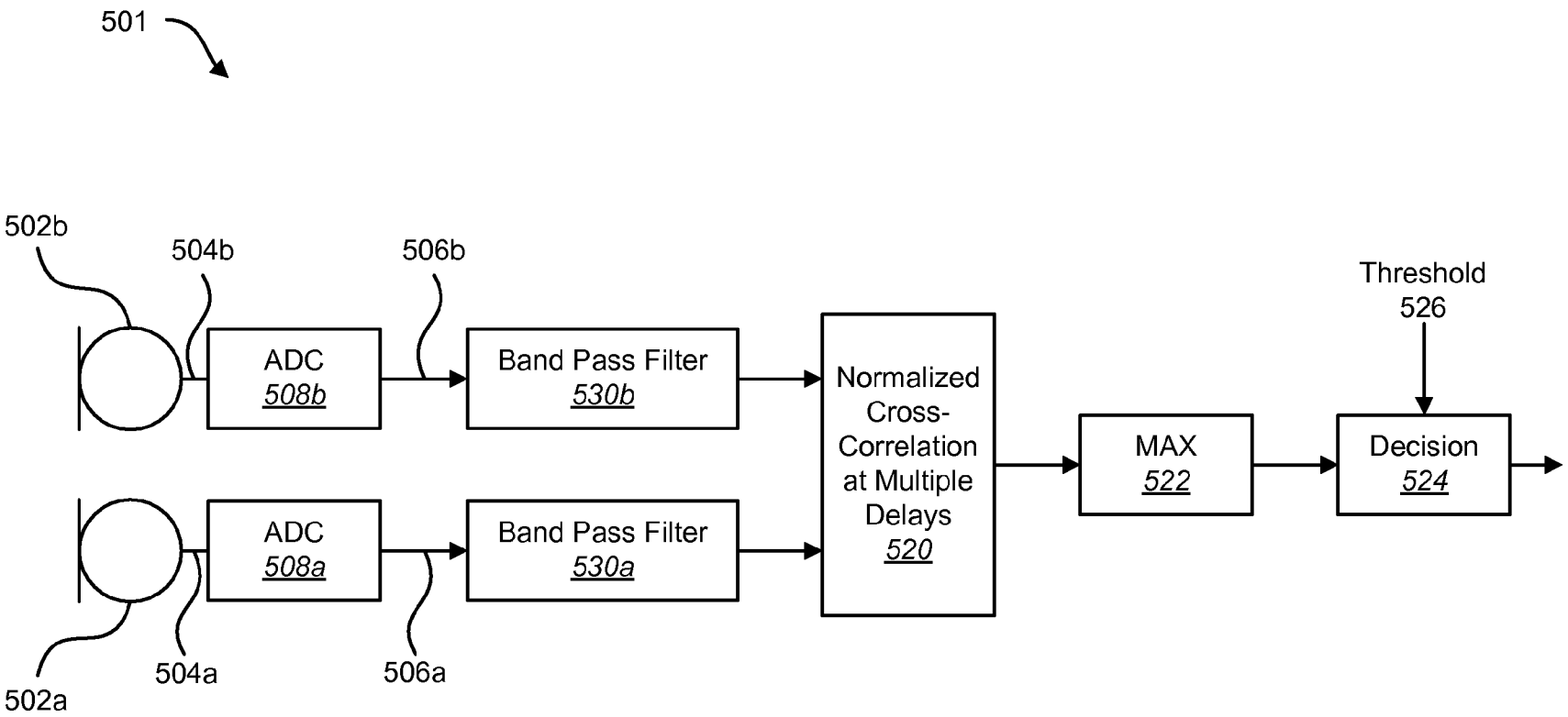
FIG. 5*a* is a block diagram illustrating certain aspects of another possible configuration of a wind noise detection system.

FIG. 5*a* is a block diagram illustrating certain aspects of another possible configuration of a wind noise detection system 501. Microphones 502*a*, 502*b* capture sound information and ADCs 508*a*, 508*b* convert analog audio signals 504*a*, 504*b* to digital audio signals 506*a*, 506*b*. Band pass filters 530*a*, 530*b* may be used instead of the HPFs and LPFs combination, as described in other configurations. The band pass filters 530*a*, 530*b* may be used to achieve the filtering as described in relation to the HPFs and LPFs. Band pass filters 530*a*, 530*b* may be designed to filter out portions of a digital signal above and below certain cutoff frequencies. The band pass filters' 530*a*, 530*b* cutoff frequencies may be the same as or different from each other's. The band pass filters 530*a*, 530*b* may be designed for emphasizing the frequency band containing the dominant wind noise content. The normalized cross-correlation block 520 may determine the normalized cross-correlation of the filtered signals at multiple (or without) delays. The MAX block 522 may determine the maximum absolute normalized cross-correlation coefficient, and the decision block 524 may determine whether wind noise is present in the signals by comparing the cross-correlation coefficient with a threshold 526.

Figure 5B:
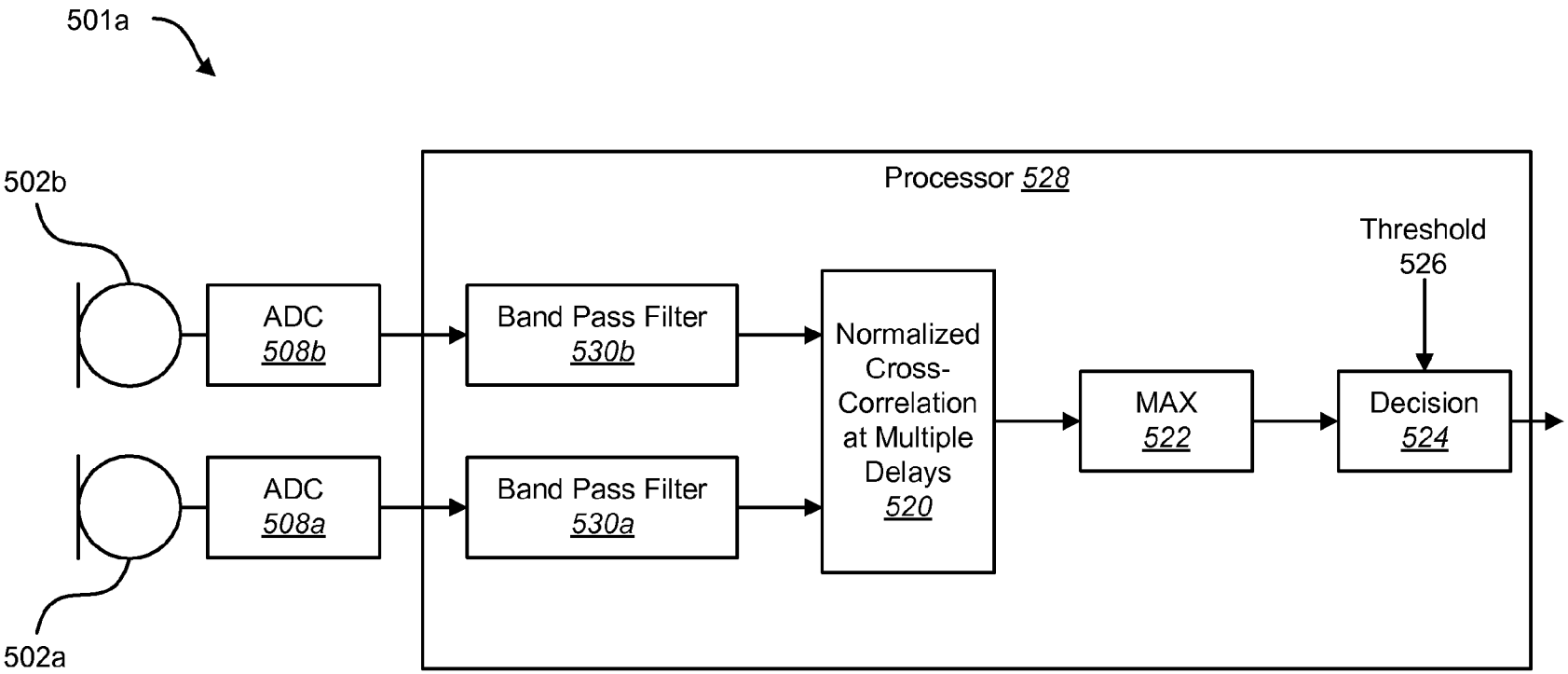
FIG. 5*b* is a block diagram illustrating certain aspects of one possible implementation of a wind noise detection system.

FIG. 5*b* is a block diagram illustrating certain aspects of one possible implementation of a wind noise detection system 501*a*. A processor 528 may execute instructions in order to implement the band pass filters 530*a*, 530*b*, normalized cross-correlation block 520, MAX block 522, and/or decision block 524.

Figure 5C:
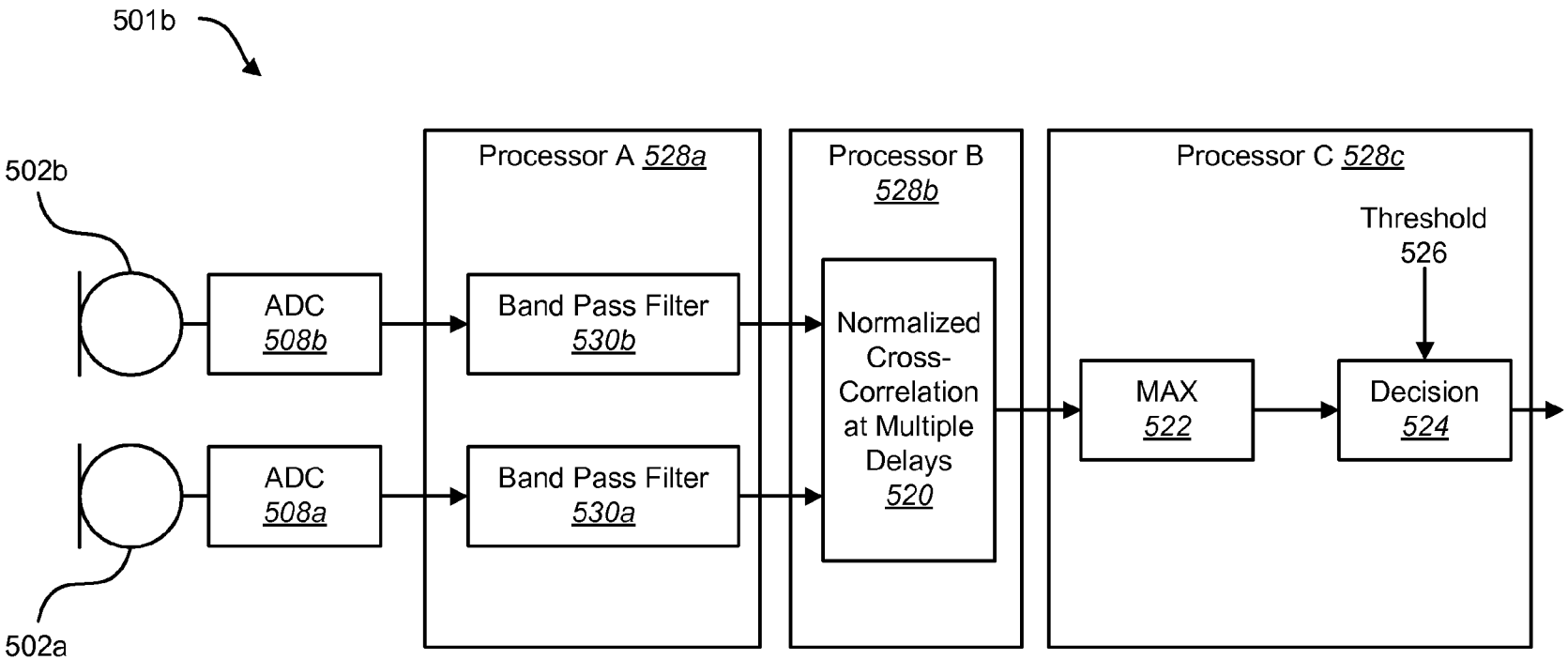
FIG. 5*c* is a block diagram illustrating certain aspects of another possible implementation of a wind noise detection system.

FIG. 5*c* is a block diagram illustrating certain aspects of another possible implementation of a wind noise detection system 501*b*. In the implementation shown in FIG. 5*c*, three processors are used for implementing the system 501*b*. Processor A 528*a* may be used to implement the band pass filters 530*a*, 530*b*. Another processor, processor B 528*b*, may process the computations necessary for the normalized cross-correlation block 520. Yet another processor, processor C 528*c*, may process the computations necessary for the MAX block 522, and/or decision block 524. Individual processors may be arranged to handle each block individually or any combination of blocks.

Figure 6:
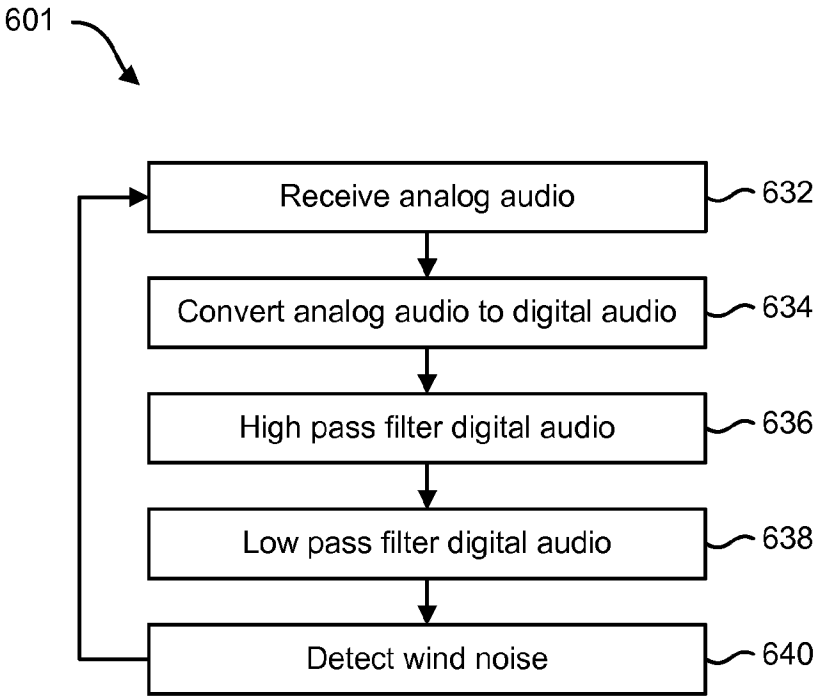
FIG. 6 is a flow diagram illustrating an example of one configuration of a method for detecting wind noise.

FIG. 6 is a flow diagram illustrating an example of one configuration of a method 601 for detecting wind noise. Analog audio captured by multiple transducers (e.g. 102*a*, 102*b*, 202*a*, 202*b*, 302*a*, 302*b*, 402*a*, 402*b*, or 502*a*, 502*b*, etc.) may be received 632. Analog audio may be converted 634 to digital audio (e.g. via ADCs 208*a*, 208*b*, 308*a*, 308*b*, 408*a*, 408*b*, or 508*a*, 508*b*, etc.). Digital audio may be high pass filtered 636 (e.g. via HPFs 316*a*, 316*b* or 416*a*, 416*b*, etc.). Digital audio may be low pass filtered 638 (e.g. via LPFs 418*a*, 418*b*, etc.). In the alternative to high and low pass filtering (636 and 638), digital audio may instead be band pass filtered (e.g. via band pass filter 530*a*, 530*b*, etc.). Wind noise may be detected 640 using filtered audio signals. This process may repeat or be continually ongoing.

Figure 7:
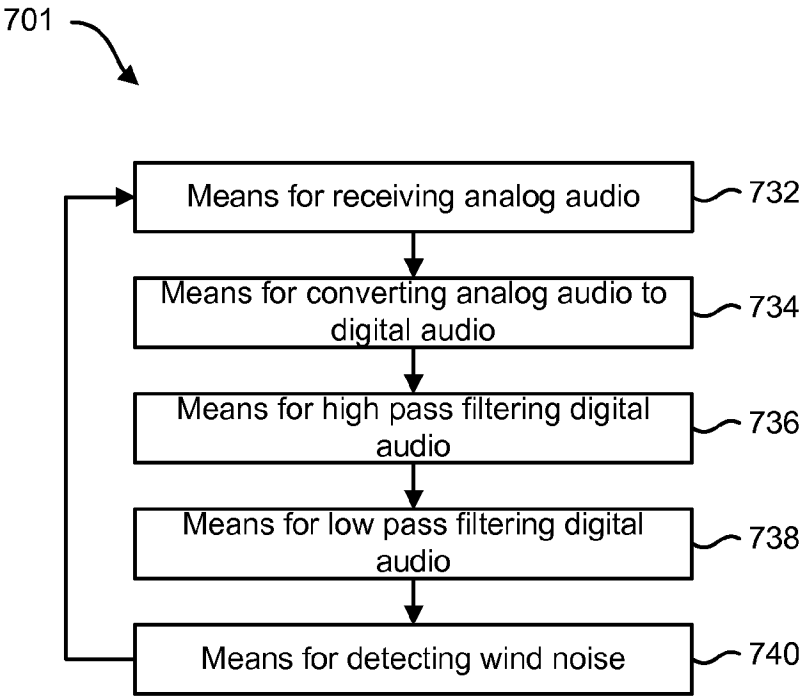
FIG. 7 is a flow diagram illustrating means-plus-function blocks corresponding to the method shown in FIG. 6.

The method described in FIG. 6 above may be performed by various hardware and/or software component(s) and/or module(s) corresponding to the means-plus-function blocks illustrated in FIG. 7. In other words, blocks 632 through 640 illustrated in FIG. 6 correspond to means-plus-function blocks 732 through 740 illustrated in FIG. 7.

Figure 8:
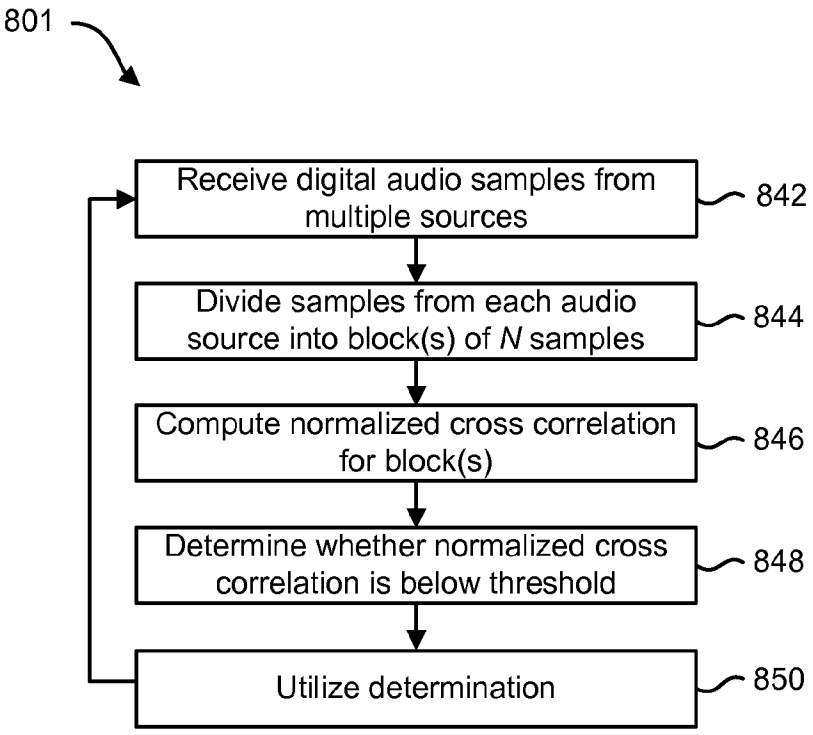
FIG. 8 is a flow diagram illustrating an example of one configuration of a method for detecting wind noise.

FIG. 8 is a flow diagram illustrating an example of one configuration of a method 801 for detecting wind noise. Analog audio signals captured by multiple transducers or microphones (e.g. 102*a*, 102*b*, 202*a*, 202*b*, 302*a*, 302*b*, 402*a*, 402*b*, or 502*a*, 502*b*, etc.) and converted to digital audio signals (e.g. via ADCs 208*a*, 208*b*, 308*a*, 308*b*, 408*a*, 408*b*, or 508*a*, 508*b*, etc.) may be received 842. The filtered microphone signals may be divided 844 into blocks or frames of N samples. For example, the number of samples N may be 80, 160, or 320, etc. The normalized cross-correlation estimate may be computed 846 for one or more block(s). The method 801 may operate on one block at a time, or it may operate on several blocks at a time. Whether operating on one block at a time or several blocks at a time, the normalized cross-correlation estimate may be computed 846 for each block.

It may then be determined 848 whether the normalized cross-correlation estimate is below a threshold value. In other words, the normalized cross-correlation estimate may be compared to a threshold value (e.g. 426 or 526, etc.) and a decision 848 may be made whether the normalized cross-correlation estimate is below the threshold for the one or more block(s). If the normalized cross-correlation estimate is not less than the threshold value, then it may be determined 848 that wind noise was not detected in a block (or blocks), and such determination 848 may be utilized 850. If the normalized cross-correlation estimate is less than the threshold value, then it may be determined 848 that wind noise was detected for a block (or blocks) and such determination may be utilized 850.

Figure 9:
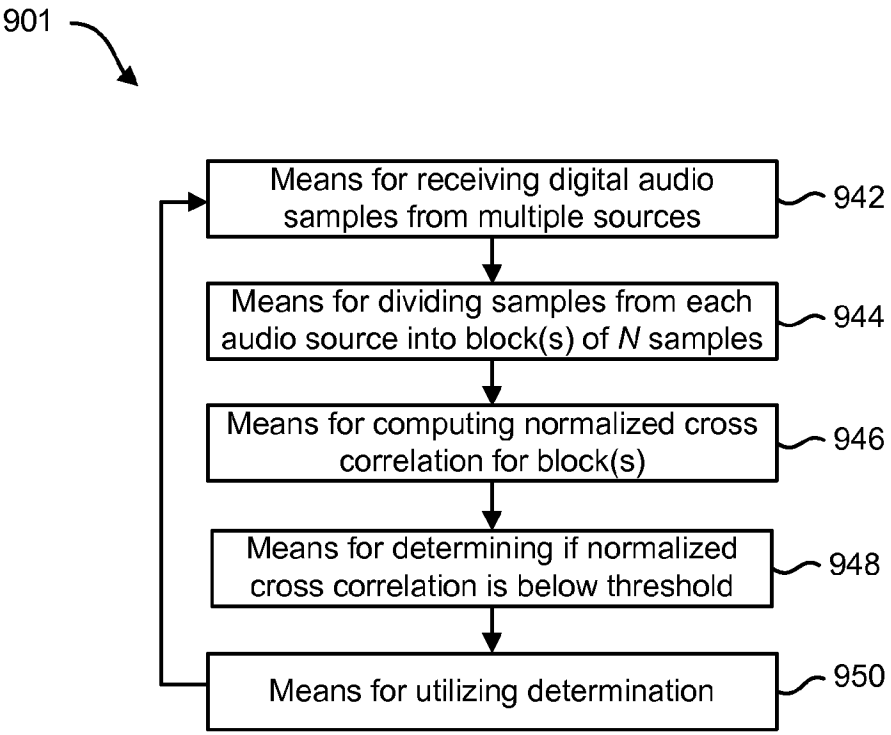
FIG. 9 is a flow diagram illustrating means-plus-function blocks corresponding to the method shown in FIG. 8.

The method described in FIG. 8 above may be performed by various hardware and/or software component(s) and/or module(s) corresponding to the means-plus-function blocks illustrated in FIG. 9. In other words, blocks 842 through 850 illustrated in FIG. 8 correspond to means-plus-function blocks 942 through 950 illustrated in FIG. 9.

Figure 10:
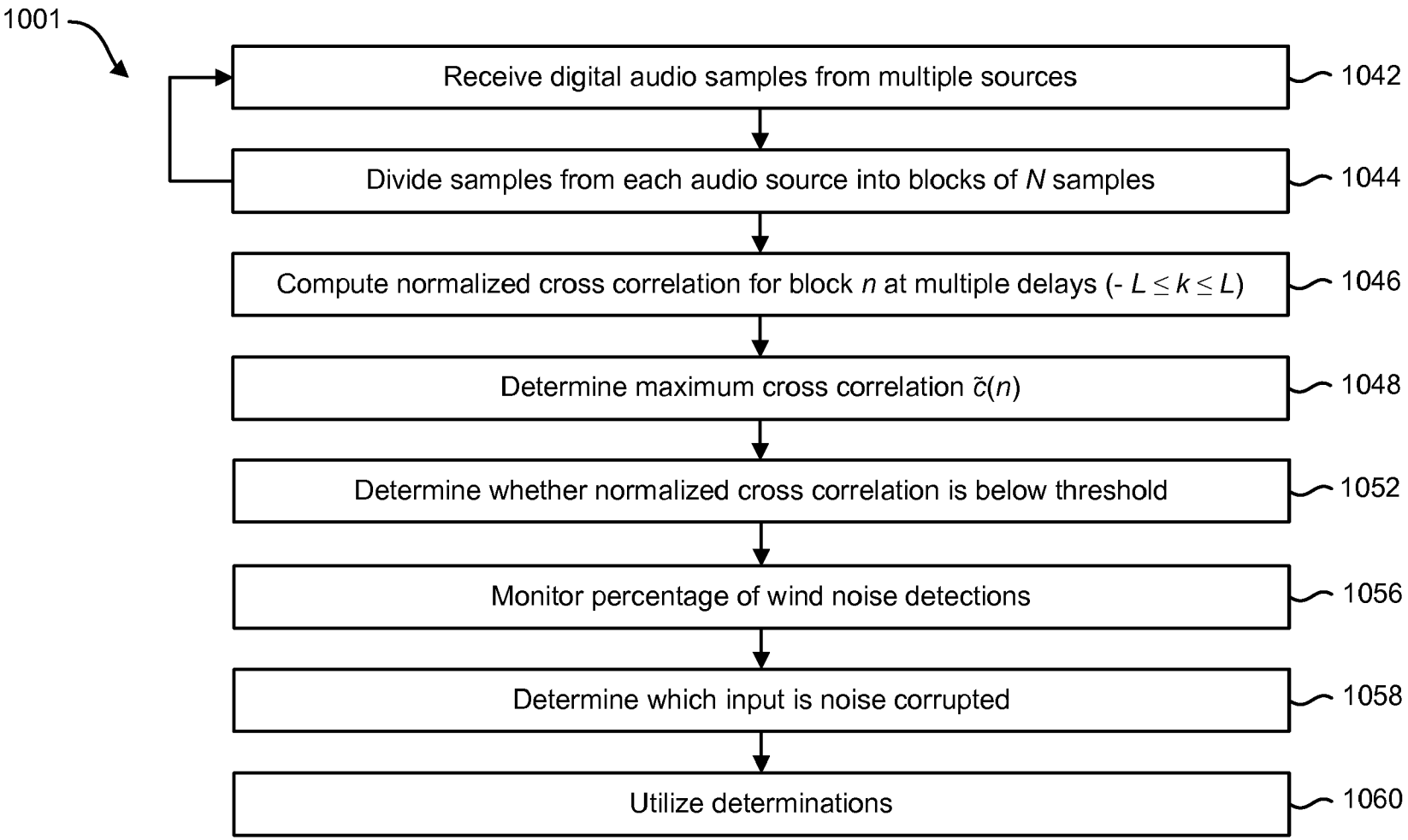
FIG. 10 is a flow diagram illustrating an example of another configuration of a method for detecting wind noise.

FIG. 10 is a flow diagram illustrating an example of another configuration of a method 1001 for detecting wind noise. Digital audio samples may be received 1042 from multiple sources. Samples from each source may be divided 1044 into blocks or frames of N samples. Each block or frame of N samples may be numbered, where the current block or frame may be referred to as block n. Receiving 1042 digital audio samples from multiple sources and dividing 1044 samples from each audio source into blocks of N samples may be ongoing processes before and during the execution of the remainder of the process shown in FIG. 10.

The normalized cross correlation may be computed 1046 for block n at multiple delay values. The maximum delay value L may be determined by the distance between the transducers (e.g. microphones). It may be defined as the smallest integer that is greater than the ratio shown in equation (1):

$$L = \left\lceil \frac{df_s}{c} \right\rceil \tag{1}$$

where c may be defined as the sound speed in air, d may be defined as the transducer (e.g. microphone) spacing, and $f_s$ may be defined as the sampling frequency (e.g. from ADCs 208*a*, 208*b*, 308*a*, 308*b*, 408*a*, 408*b*, or 508*a*, 508*b*, etc.). If the microphone spacing is unknown, a maximum value of d=10 cm may be assumed. The multiple delay values may be numbered k and may be within the range of the maximum delay value L (i.e., $-L \leqq k \leqq L$). The estimated normalized cross-correlation may be designated $\hat{c}(n,k)$, while a smoothed version may be designated $\bar{c}(n,k)$.

The maximum absolute normalized cross-correlation (e.g. over the delay values k) may be determined 1048 and may be designated $\tilde{c}(n)$ (e.g. 422, 522, etc.). This determination may be expressed as follows in equation (2):

$$\tilde{c}(n) = \max_k |\bar{c}(n, k)| \tag{2}$$

The maximum normalized cross-correlation may be compared to a threshold value (e.g. 526 or 426, etc.) and a decision 1052 may be made whether the maximum normalized cross-correlation is below the threshold. If the maximum normalized cross-correlation is not below the threshold, it may be determined 1052 that wind noise was not detected for that block or frame n. If the maximum normalized cross-correlation is below the threshold, then it may be determined 1052 that wind noise was detected for that block or frame n.

The percentage of wind noise detections may be monitored 1056. The wind noise detection may be made more robust by monitoring the detector output over a "window" (e.g. a number P of blocks or frames) and testing if the detector consistently detects wind noise for a predetermined percentage of blocks or frames (e.g. 80%). Once enough detections are observed, the presence of wind noise in the transducer (e.g. microphone) signals may be determined. The "window" may be a sliding window (e.g., one block or frame may be part of multiple windows as the sliding window slides across successive blocks or frames), or a discrete window (e.g., a block or frame is only part of one window).

The above approach may only detect the presence of wind noise in one or all of the microphone signals. It may be necessary to identify 1058 which microphone signals are corrupted by wind noise and which ones are not. The energy for each audio signal may be used to determine 1058 which microphone signal(s) are corrupted by noise. Energy estimates for each audio signal may be calculated at an earlier step (e.g. 1046). For example, an energy estimate for a first microphone signal may be calculated and designated $p_1(n)$, with $p_2(n)$ similarly calculated and designated for a second microphone signal. At each block n, the maximum of the energy estimates $p_1(n)$ and $p_2(n)$ may be calculated as shown in equation (3):

$$p_{max}(n)=\max[p_1(n),p_2(n)] \tag{3}$$

Presence of wind noise in individual microphones may be detected by comparing the individual energy estimates $p_1(n)$ and $p_2(n)$ with the maximum value $p_{max}(n)$. For example, if $p_1(n)/p_{max}(n)>\eta$, then it may be established that the first microphone signal may be corrupted with wind noise. The same type of detection may be done for other microphones. Here $\eta$ represents the threshold for detection, and $0<\eta<1$ (e.g. $\eta$ may be 0.1, 0.2, etc.). This approach to detect wind noise in individual microphones may work if the wind noise to acoustic signal ratio is high. If the wind noise on the microphones is low, then this approach may not yield a good detection performance for the individual microphone signals.

The determinations of whether wind noise has been detected (e.g. over a certain percentage of frames 1056) and/or which input(s) is noise corrupted may be utilized 1060.

Figure 11:
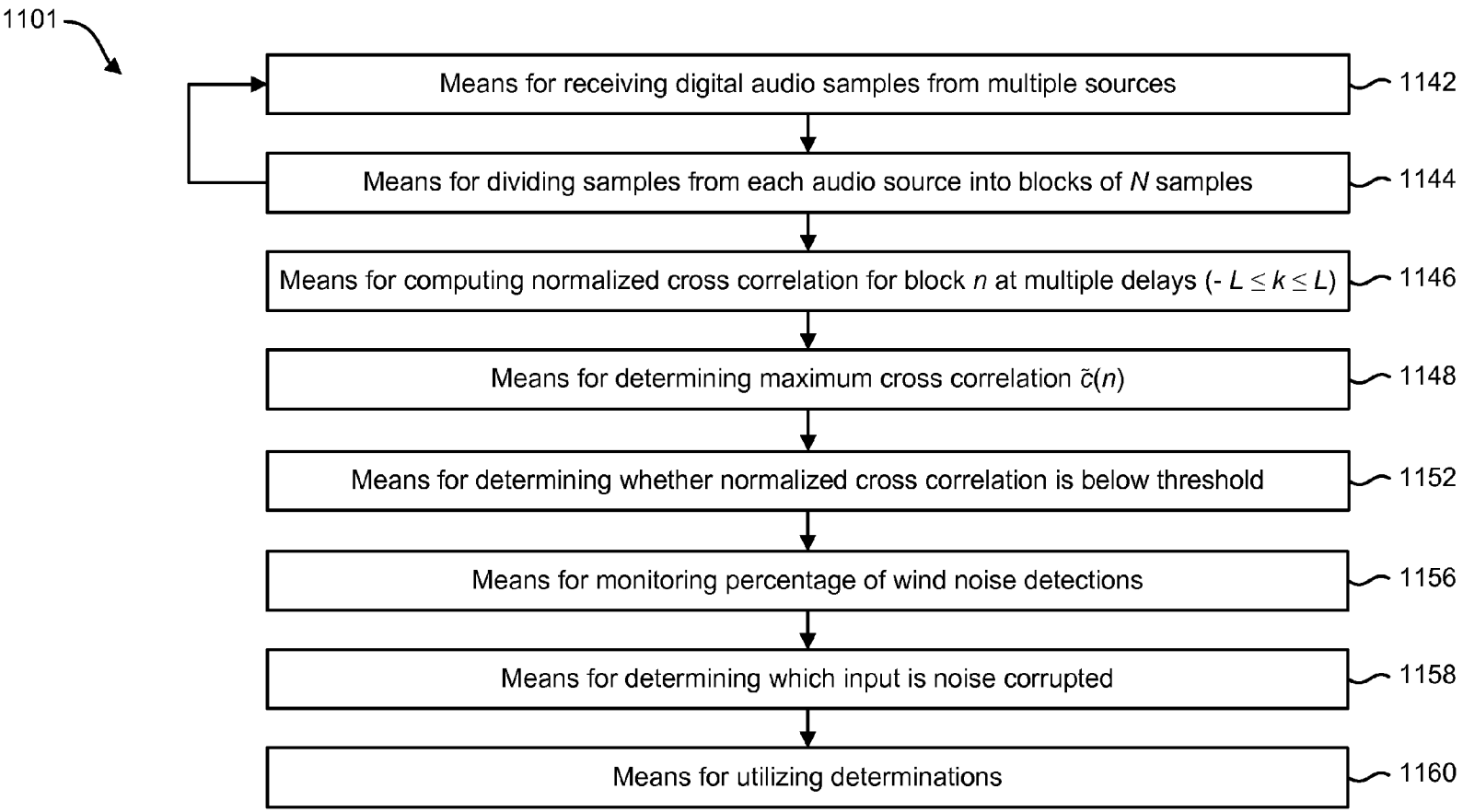
FIG. 11 is a flow diagram illustrating means-plus-function blocks corresponding to the method shown in FIG. 10.

The method described in FIG. 10 above may be performed by various hardware and/or software component(s) and/or module(s) corresponding to the means-plus-function blocks illustrated in FIG. 11. In other words, blocks 1042 through 1060 illustrated in FIG. 10 correspond to means-plus-function blocks 1142 through 1160 illustrated in FIG. 11.

Figure 12:
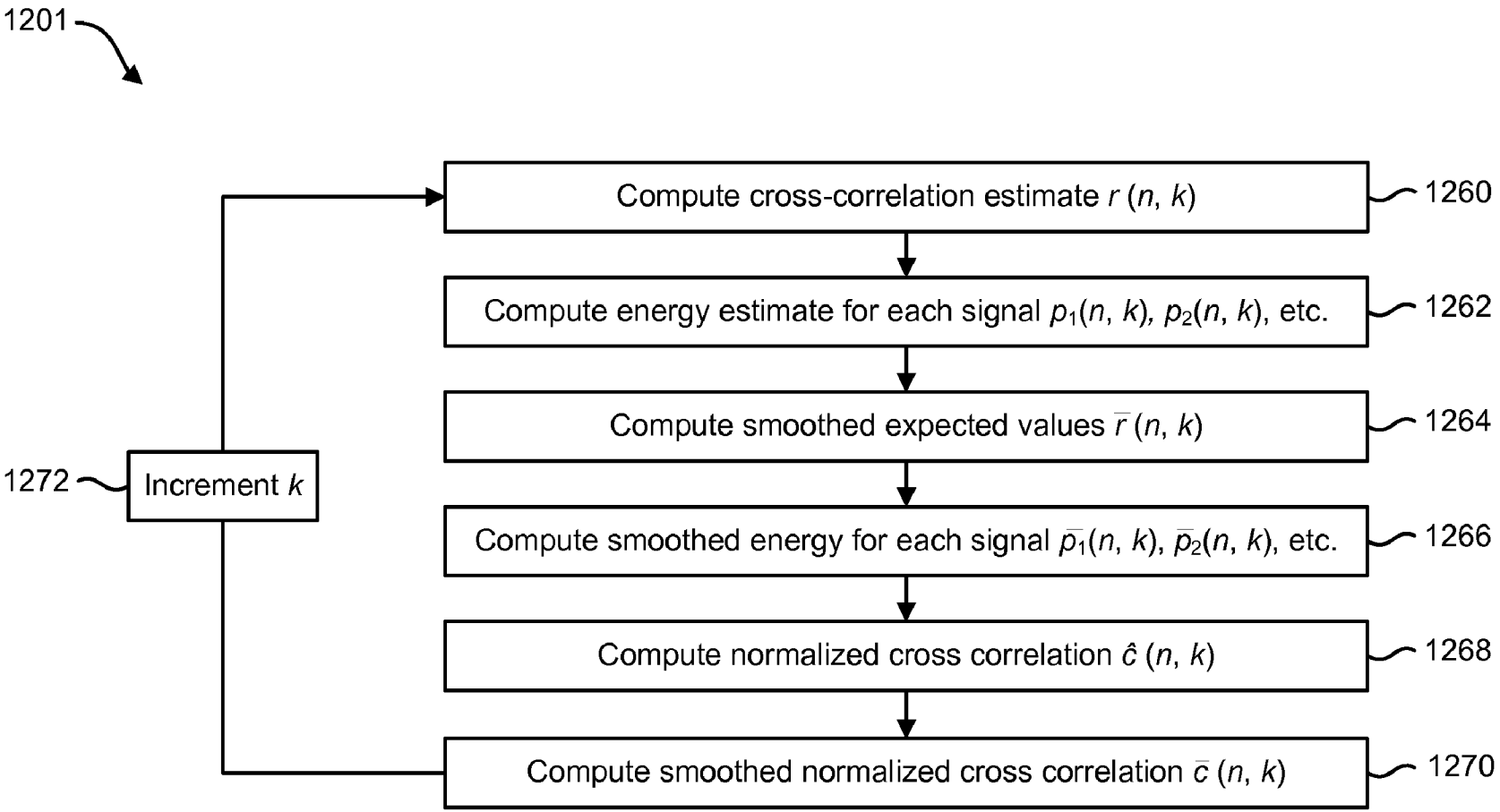
FIG. 12 is a flow diagram illustrating an example of one configuration of a method for computing the normalized cross-correlation of multiple audio signals at multiple delays.

FIG. 12 is a flow diagram illustrating an example of one configuration of a method 1201 for computing the normalized cross-correlation of multiple audio signals at multiple delays (e.g. 846, 1046). For ease of illustration, an example of a system with two microphones is given hereinafter, though the method(s) described may be extended to systems with more microphones. A signal that has been captured by a first microphone (e.g. 404*a*, etc.), converted to a digital signal (e.g. 406*a*) by a first ADC (e.g. 408*a*, etc.), and filtered using a first HPF (e.g. 416*a*, etc.) and a first LPF (e.g. 418*a*, etc.), may be designated $X_n(m)$, where n is the block number and m is the sample number. Similarly, a signal that has been captured by a second microphone (e.g. 404*b*, etc.), converted to a digital signal (e.g. 406*b*, etc.) by a second ADC (e.g. 408*b*), and filtered using a second HPF (e.g. 416*b*, etc.), and a second LPF (e.g. 418*b*, etc.), may be designated $Y_n(m)$, where n is the block number and m is the sample number inside a block. The sample number m takes values in the range: $nN\leqq m<(n+1)N$. The normalized cross-correlation coefficients c(n,k) as a function of time block n and the delay value k may be theoretically expressed using the following equation (4).

$$c(n,k)=\frac{E[X_n(m)Y_n(m-k)]}{\sqrt{EX_n^2(m)EY_n^2(m)}},\ k=-L,\ \ldots\ ,L \tag{4}$$

Here, $EX_n(m)$ is the expected value of the signal X(m) at block n: $nN\leqq m<(n+1)N$. Expected values of the signal random processes may not be known in advance. Hence, estimates of the expected values may be computed using temporal averaging approaches. These approaches yield cross-correlation estimates r(n,k) and energy estimates $p_1(n)$ and $p_2(n)$ as illustrated in equations (5), (6), and (7) below:

$$\begin{aligned} r(n,k) &= E[X_n(m)Y_n(k+m)] \\ &= \frac{1}{N}\sum_{m=0}^{N-1} X(nN+m)Y(nN+m-k) \end{aligned} \tag{5}$$

$$p_1(n)=EX_n^2(m)=\frac{1}{N}\sum_{m=0}^{N-1}X^2(nN+m) \tag{6}$$

$$p_2(n)=EY_n^2(m)=\frac{1}{N}\sum_{m=0}^{N-1}Y^2(nN+m) \tag{7}$$

where $-L\leqq k\leqq L$ represents the range of delays over which cross-correlation may be computed (as described in equation (1) above). The cross correlation estimate r(n,k) may be computed 1260 accordingly (e.g. using equation (5)). The energy estimates for the first signal $p_1(n)$ and the second signal $p_2(n)$ may also be computed 1262 accordingly (e.g. using equations (6) and (7)).

The cross-correlation estimates r(n,k) may be smoothed 1264 over time to reduce the variance of the estimates. The energy estimates $p_1(n)$ and $p_2(n)$ may be smoothed 1266 over time in order to reduce the variance of the estimates. The smoothing operations may be performed according to equations (8), (9), and (10):

$$\bar{r}(n,k)=\beta_0\bar{r}(n-1,k)+(1-\beta_0)r(n,k) \tag{8}$$

$$\bar{p}_1(n)=\beta_1\bar{p}_1(n-1)+(1-\beta_1)p_1(n) \tag{9}$$

$$\bar{p}_2(n)=\beta_2\bar{p}_2(n-1)+(1-\beta_2)p_2(n) \tag{10}$$

The smoothing constants $\beta_0$, $\beta_1$, and $\beta_2$ may all be equal to each other or may be different from each other. The higher the value used for the smoothing constants, the lower the variance of the computed estimates. However, higher values of the smoothing constant may introduce delay in the detector output as the energy estimates are smoothed very slowly. The values of the smoothing constants may be determined empirically. Values in the range 0.9-0.99 are found to provide good results.

An estimate of the normalized cross-correlation value may be computed 1268 from the smoothed cross-correlation estimates and energy estimates using equation (11):

$$\hat{c}(n,k) = \frac{\bar{r}(n,k)}{\sqrt{\bar{p}_1(n)\bar{p}_2(n)}} \quad k = -L, \ldots, L \tag{11}$$

To avoid the square-root operation in the above calculation, the square of the normalized cross-correlation estimate may be used.

The normalized cross-correlation estimate may also be further smoothed 1270 to minimize the variations in the above estimate (see equation (12)):

$$\bar{c}(n,k)=\alpha\bar{c}(n-1,k)+(1-\alpha)\hat{c}(n,k) \tag{12}$$

The higher the value used for the smoothing constant $\alpha$, the lower the variance of the computed estimate(s). However, high values of the smoothing constant may introduce considerable delay in the response of the detector. Empirically, values in the range 0.7-0.9 have been found to provide good detection results. Upon computing a cross-correlation estimate (whether smoothed or otherwise) at one delay value, k may be incremented 1272 and the process may be repeated for another delay value.

Figure 13:
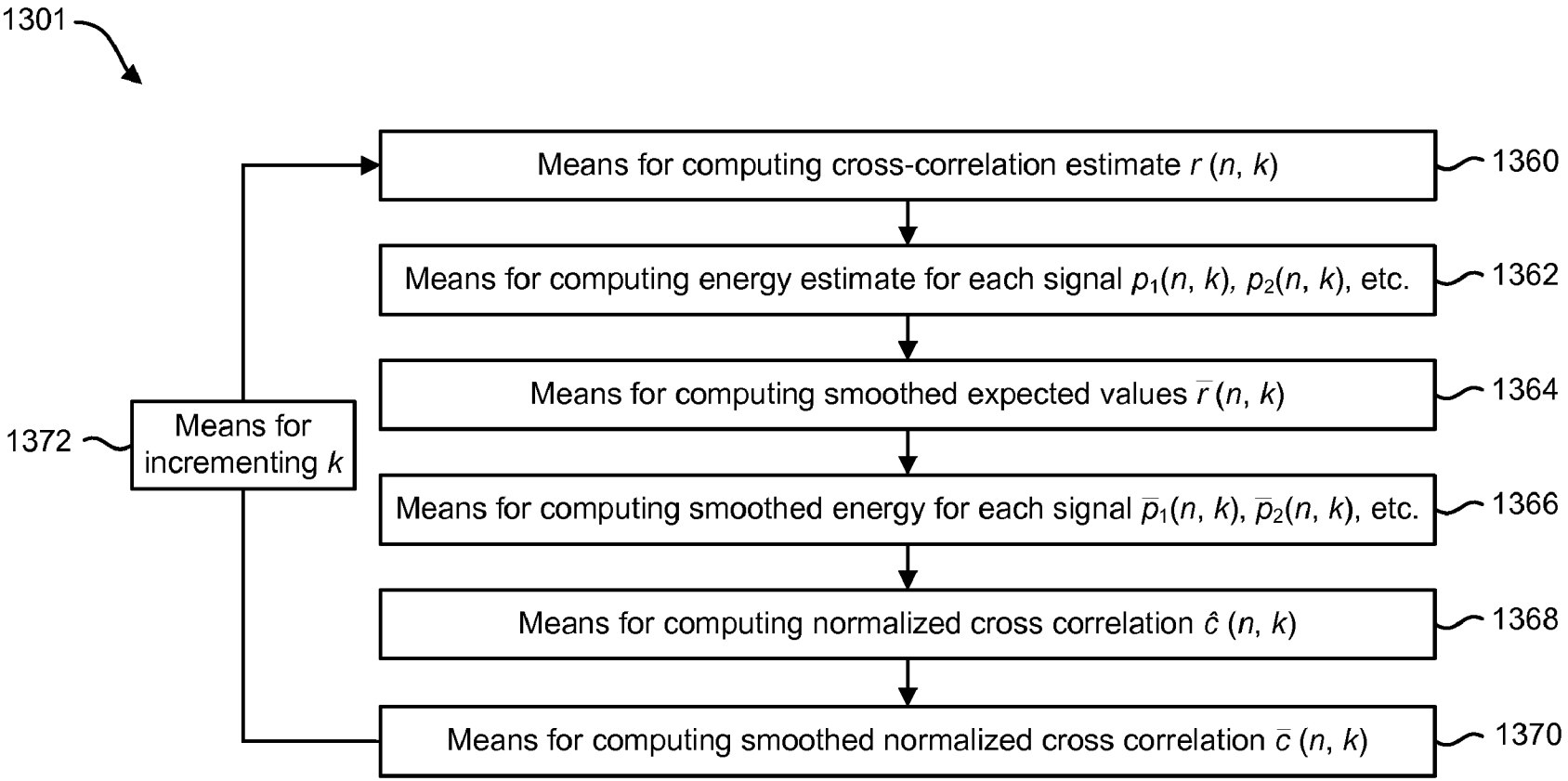
FIG. 13 is a flow diagram illustrating means-plus-function blocks corresponding to the method shown in FIG. 12.

FIG. 13 is a flow diagram illustrating means-plus-function blocks corresponding to the method shown in FIG. 12. The method described in FIG. 12 above may be performed by various hardware and/or software component(s) and/or module(s) corresponding to the means-plus-function blocks illustrated in FIG. 13. In other words, blocks 1260 through 1272 illustrated in FIG. 12 correspond to means-plus-function blocks 1360 through 1372 illustrated in FIG. 13.

Figure 14:
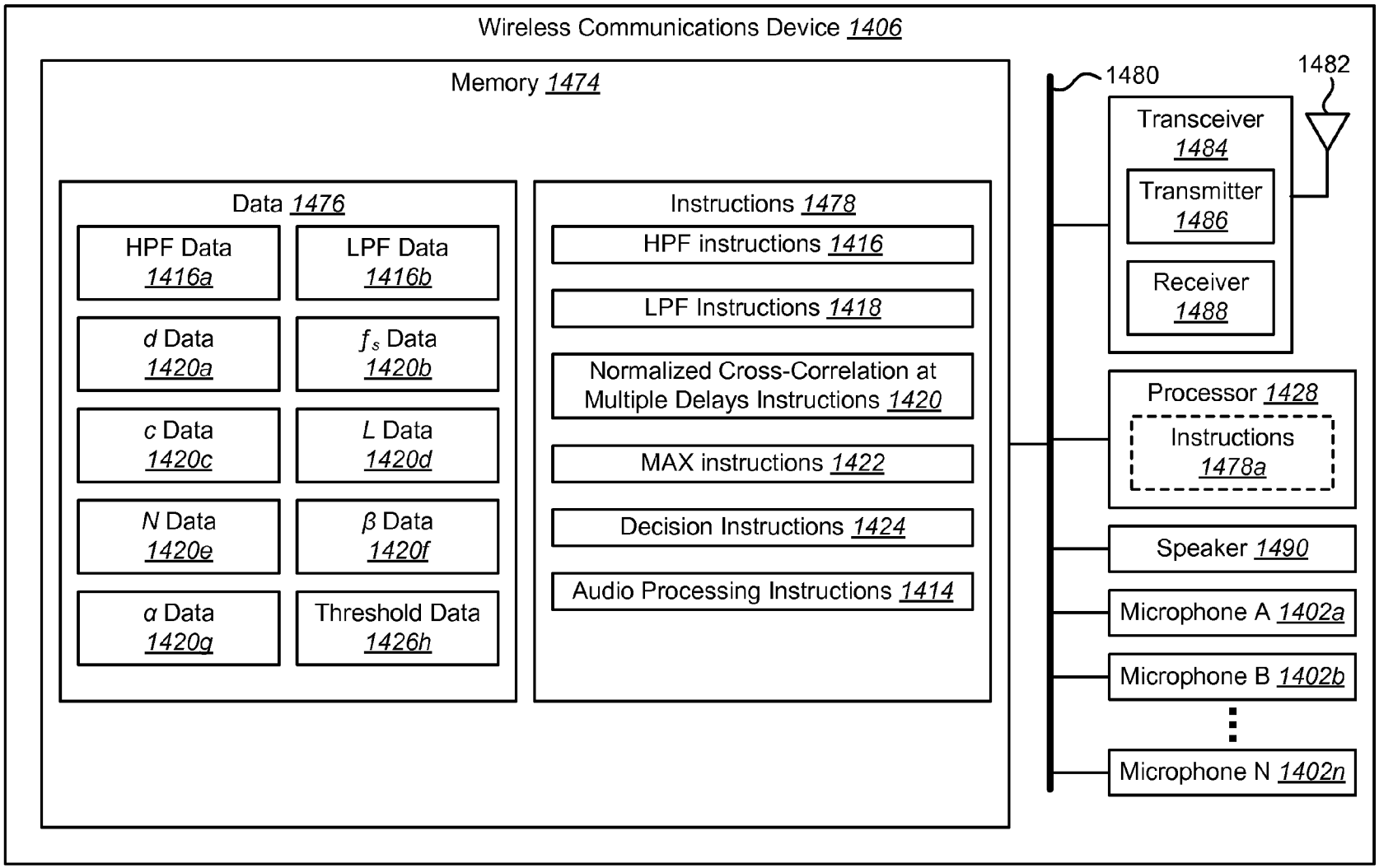
FIG. 14 is a block diagram illustrating various components that may be utilized in a mobile device that may be used to implement the methods described herein.

FIG. 14 is a block diagram illustrating various components that may be utilized in a wireless communication device 1406. The wireless communication device 1406 is an example of a device that may be used to implement the systems and methods described herein for detecting wind noise.

The mobile device 1406 includes a processor 1428. The processor 1428 may be a general purpose single- or multi-chip microprocessor (e.g., an ARM), a special purpose microprocessor (e.g., a digital signal processor (DSP)), a microcontroller, a programmable gate array, etc. The processor may be referred to as a central processing unit (CPU). Although just a single processor is shown in the mobile device 1406 of FIG. 14, in an alternative configuration, a combination of processors 1428 (e.g., an ARM and DSP) could be used.

The mobile device 1406 also includes memory 1474. The memory 1474 may be any electronic component capable of storing electronic information. The memory 1474 may be embodied as random access memory (RAM), read only memory (ROM), magnetic disk storage media, optical storage media, flash memory devices in RAM, on-board memory included with the processor, EPROM memory, EEPROM memory, registers, and so forth, including combinations thereof.

Data 1476 and instructions 1478 may be stored in the memory 1474. The instructions 1478 may be executable by the processor 1428 to implement various functions. Executing the instructions 1478 may involve the use of the data 1476 that is stored in the memory 1474. When the processor 1428 executes the instructions 1478, it 1428 may load certain instructions 1478*a* onto the processor 1428. The loaded instructions 1478*a* are illustrated.

Some examples of the data 1476 in the memory 1474 include, but are not limited to, data for filters 1416*a*-1416*b* (high-pass filter, low-pass filter, band-pass filter), data for the computations as described earlier 1420*a*-1420*g*, threshold data 1426*h*, data from samples of digital audio (not shown), etc. Other types of data 1476 that are relevant to implementing the techniques described herein may also be included in the memory 1474.

Some examples of the instructions 1478 in the memory 1474 include: instructions for implementing one or more high-pass filters 1416; instructions for implementing one or more low-pass filters 1418; instructions for determining the normalized cross-correlations 1420; instructions for determining the maximum 1422; instructions for determining when wind noise was detected 1424; audio processing instructions 1414; as well as other instructions corresponding to the systems and methods described herein. Other instructions 1478 that are relevant to implementing the techniques described herein may also be included in the memory 1474.

The mobile device 1406 may also include a transmitter 1486 and a receiver 1488 to allow transmission and reception of data between the mobile device 1406 and a remote location. The transmitter 1486 and receiver 1488 may be combined into a transceiver 1484. An antenna 1482 may be electrically coupled to the transceiver 1484. The mobile device 1406 may also include (not shown) multiple transmitters, multiple receivers, multiple transceivers and/or multiple antenna.

The mobile device 1406 may also include a speaker 1490, where a user may listen to audio. The mobile device 1406 may also include two or more microphones (1402*a*, 1402*b*, . . . , 1402*n*, etc.).

It may be desirable to place the microphones (e.g. 1402*a*, 1402*b*, . . . , 1402*n*, etc.) close to each other. The present systems and methods try to exploit the fact that the wind noise caused by interaction between microphone and adjacent air flowing are not correlated among different microphones. The correlation may be high when there is no wind noise and low when there is wind noise. An assumption may be made that signals besides the wind noise (e.g. audio, voice, etc.) are correlated in the low frequency range (e.g. 200 Hz to 1000 Hz). The closer the microphones, the higher the correlation due to all other signals may be. Therefore, it may be desirable to place the microphones close to each other to maximize the distinction in correlation (e.g. between 1 cm to 4 cm). If the microphones are placed further apart, the cutoff frequency of the LPFs (e.g. 418*a*, 418*b*, etc.) may need to be reduced and the detection thresholds and smoothing parameters may also need to be changed in order to obtain good results.

The various components of the mobile device 1406 may be coupled together by a bus system 1480 which may include a power bus, a control signal bus, and a status signal bus in addition to a data bus. However, for the sake of clarity, the various buses are illustrated in FIG. 14 as the bus system 1480.

In the above description, reference numbers have sometimes been used in connection with various terms. Where a term is used in connection with a reference number, this is meant to refer to a specific element that is shown in one or more of the Figures. Where a term is used without a reference number, this is meant to refer generally to the term without limitation to any particular Figure. For example, a reference to "mobile station 1406" refers to the specific mobile station that is shown in FIG. 14. However, the use of "mobile station" without a reference number refers to any mobile station that is appropriate for the context in which the term is used, and is not limited to any particular mobile station shown in the Figures.

As used herein, the term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The term "processor" should be interpreted broadly to encompass a general purpose processor, a central processing unit (CPU), a microprocessor, a digital signal processor (DSP), a controller, a microcontroller, a state machine, and so forth. Under some circumstances, a "processor" may refer to an application specific integrated circuit (ASIC), a programmable logic device (PLD), a field programmable gate array (FPGA), etc. The term "processor" may refer to a combination of processing devices, e.g., a combination of a DSP and a microprocessor, a plurality of microprocessors, one or more microprocessors in conjunction with a DSP core, or any other such configuration.

The term "memory" should be interpreted broadly to encompass any electronic component capable of storing electronic information. The term memory may refer to various types of processor-readable media such as random access memory (RAM), read-only memory (ROM), non-volatile random access memory (NVRAM), programmable read-only memory (PROM), erasable programmable read only memory (EPROM), electrically erasable PROM (EEPROM), flash memory, magnetic or optical data storage, registers, etc. Memory is said to be in electronic communication with a processor if the processor can read information from and/or write information to the memory. Memory may be integral to a processor and still be said to be in electronic communication with the processor.

The terms "instructions" and "code" should be interpreted broadly to include any type of computer-readable statement (s). For example, the terms "instructions" and "code" may refer to one or more programs, routines, sub-routines, functions, procedures, etc. "Instructions" and "code" may comprise a single computer-readable statement or many computer-readable statements.

The functions described herein may be implemented in hardware, software, firmware, or any combination thereof. If implemented in software, the functions may be stored as one or more instructions on a computer-readable medium. The term "computer-readable medium" refers to any available medium that can be accessed by a computer. By way of example, and not limitation, a computer-readable medium may comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

Further, it should be appreciated that modules and/or other appropriate means for performing the methods and techniques described herein can be downloaded and/or otherwise obtained by a mobile station and/or base station as applicable. For example, such a device can be coupled to a server to facilitate the transfer of means for performing the methods described herein. Alternatively, various methods described herein can be provided via a storage means (e.g., random access memory (RAM), read only memory (ROM), a physical storage medium such as a compact disc (CD) or floppy disk, etc.), such that a mobile station and/or base station can obtain the various methods upon coupling or providing the storage means to the device. Moreover, any other suitable technique for providing the methods and techniques described herein to a device can be utilized.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for detecting wind noise, the method comprising:

receiving at least two audio signals;

filtering the at least two audio signals to reduce higher frequencies and to reduce lower frequencies to provide at least two filtered audio signals;

computing a cross correlation of the at least two filtered audio signals for multiple delays;

determining a maximum cross correlation from the cross correlations computed for the multiple delays; and detecting wind noise by comparing the maximum cross correlation with a threshold.

2. The method of claim 1, wherein the filtering to reduce the higher frequencies is accomplished by a low pass filter.

3. The method of claim 1, wherein the filtering to reduce the lower frequencies is accomplished by a high pass filter.

4. The method of claim 1, wherein the filtering to reduce the higher frequencies and to reduce the lower frequencies is accomplished by a band pass filter.

5. The method of claim 1, wherein computing the cross correlation comprises computing a normalized cross correlation.

6. The method of claim 1, further comprising converting the at least two audio signals from analog audio to digital audio.

7. The method of claim 1 wherein the at least two audio signals comprise exactly two audio signals.

8. The method of claim 1, further comprising:

converting the at least two audio signals from analog audio to digital audio;

dividing the digital audio into multiple blocks; and wherein the computing, the determining and the detecting are performed relative to the blocks.

9. The method of claim 1, wherein computing the cross correlation comprises computing a smoothed normalized cross correlation.

10. The method of claim 9, further comprising monitoring a percentage of wind noise detections over a window and comparing the percentage with a threshold percentage to determine wind noise for the window.

11. The method of claim 1, further comprising determining which audio signal of the at least two audio signals has wind noise.

12. A wireless communication device configured to detect wind noise, the device comprising:

at least two microphones for receiving at least two audio signals;

filters for filtering the at least two audio signals to reduce higher frequencies and to reduce lower frequencies to provide at least two filtered audio signals;

a cross correlation block coupled to the filters for computing the cross correlation of the at least two filtered audio signals for multiple delays;

a maximum determination block coupled to the cross correlation block for determining a maximum cross correlation from the cross correlations computed for die multiple delays; and a decision block coupled to the maximum determination block for detecting wind noise by comparing the maximum cross correlation with a threshold.

13. The communication device of claim 12, wherein the filters include a low pass filter to reduce the higher frequencies.

14. The communication device of claim 12, wherein the filters include a high pass filter to reduce the lower frequencies.

15. The communication device of claim 12, wherein the filters include a band pass filter to reduce the higher frequencies and to reduce the lower frequencies.

16. The communication device of claim 12, wherein the cross correlation block is configured to compute the cross correlation by computing a normalized cross correlation.

17. The communication device of claim 12, further comprising analog to digital converters for converting the at least two audio signals front analog audio to digital audio.

18. The communication device of claim 12, wherein the at least two microphones comprise exactly two microphones.

19. The communication device of claim 12, further comprising:

analog to digital converters for converting the at least two audio signals from analog audio to digital audio;

a processor for dividing the digital audio into multiple blocks; and wherein the cross correlation block, the maximum determination block and the decision block are performed relative to the blocks.

20. The communication device of claim 12, wherein the cross correlation block is configured to compute the cross correlation by computing a smoothed normalized cross correlation.

21. The communication device of claim 20, wherein the processor is further configured to monitor a percentage of wind noise detections over a window and compare a percentage with a threshold percentage to determine wind noise for the window.

22. The communication device of claim 12, further comprising a processor configured to determine which audio signal of the at least two audio signals has wind noise.

23. A wireless communication device configured for detecting wind noise, comprising:

a processor;

memory in electronic communication with the processor;

instructions stored in the memory, the instructions being executable by the processor to:

receive at least two audio signals;

fitter the at least two audio signals to reduce higher frequencies and to reduce lower frequencies to provide at least two filtered audio signals;

compute a cross correlation of the at least two filtered audio signals for multiple delays;

determine a maximum cross correlation from the cross correlations computed for the multiple delays; and detect wind noise by comparing the maximum cross correlation with a threshold.

24. The wireless communication device of claim 23, wherein the instructions are further executable to implement a low pass filter to reduce the higher frequencies.

25. The wireless communication device of claim 23, wherein the instructions are further executable to implement a high pass filter to reduce the lower frequencies.

26. The wireless communication device of claim 23, wherein the instructions are further executable to implement a band pass filter reduce the higher frequencies and to reduce the lower frequencies.

27. The wireless communication device of claim 23, wherein the instructions are further executable to compute the cross correlation by computing a normalized cross correlation.

28. The wireless communication device of claim 23, wherein the instructions are further executable to convert the at least two audio signals from analog audio to digital audio.

29. The wireless communication device of claim 23, wherein the at least two audio signals comprise exactly two audio signals.

30. The wireless communication device of claim 23, further comprising:

executable instructions to convert the at least two audio signals from analog audio to digital audio;

executable instructions to divide the digital audio into multiple blocks; and wherein the instructions for computing, the instructions for determining and the instructions for detecting are performed relative to the blocks.

31. The wireless communication device of claim 23, wherein the instructions are further executable to compute the cross correlation by computing the smoothed normalized cross correlation.

32. The wireless communication device of claim 31, wherein the instructions are further executable to monitor a percentage of wind noise detections over a window and to compare the percentage with a threshold percentage to determine wind noise for the window.

33. The wireless communication device of claim 23, wherein the instructions are further executable to determine which audio signal of the at least two audio signals has wind noise.

34. A wireless communication device configured for detecting wind noise, comprising:

means for receiving at least two audio signals;

means for filtering the at least two audio signals to reduce higher frequencies and to reduce lower frequencies to provide at least two filtered audio signals;

means for computing the cross correlation of the at least two filtered audio signals for multiple delays;

means for determining a maximum cross correlation from the cross correlations computed for the multiple delays; and means for detecting wind noise by comparing the maximum cross correlation with a threshold.

35. The wireless communication device of claim 34, wherein the means for computing the cross correlation comprises means for computing the normalized cross correlation.

36. The wireless communication device of claim 34, further comprising means for converting the at least two audio signals from analog audio to digital audio.

37. The wireless communication device of claim 34, wherein the at least two audio signals comprise exactly two audio signals.

38. The wireless communication device of claim 34, further comprising:

means for converting the at least two audio signals from analog audio to digital audio;

means for dividing the digital audio into multiple blocks; and wherein the means for computing, the means for determining and the means for detecting are performed relative to the blocks.

39. A computer-program product for detecting wind noise, the computer-program product comprising a computer-readable medium having instructions thereon, the instructions comprising:

code for receiving at least two audio signals;

code for filtering the at least two audio signals to reduce higher frequencies and to reduce lower frequencies to provide at least two filtered audio signals;

code for computing the cross correlation of the at least two filtered audio signals for multiple delays;

code for determining a maximum cross correlation from the cross correlations computed for the multiple delays; and code for detecting wind noise by comparing the maximum cross correlation with a threshold.

40. The computer-program product of claim 39, wherein the code for computing the cross correlation comprises code for computing a normalized cross correlation.

41. The computer-program, product of claim 39, wherein the instructions further comprising code for converting the at least two audio signals from analog audio to digital audio.

42. The computer-program product of claim 39, wherein the at least two audio signals comprise exactly two audio signals.

43. The computer-program product of claim 39, further comprising:

code for converting the at least two audio signals from analog audio to digital audio;

code for dividing the digital audio into multiple blocks; and wherein the code for computing, the code for determining and the code for detecting are performed relative to the blocks.

44. An integrated circuit for detecting wind noise, the integrated circuit being configured to:

receive at least two audio signals;

filter the at least two audio signals to reduce higher frequencies and to reduce lower frequencies to provide at least two filtered audio signals;

compute the cross correlation of the at least two filtered audio signals for multiple delays;

determine a maximum cross correlation from the cross correlations computed for the multiple delays; and detect wind noise by comparing the maximum cross correlation with a threshold.

45. The integrated circuit of claim 44, wherein the integrated circuit is further configured to compute the cross correlation by computing a normalized cross correlation.

* * * * *